US005260709A

United States Patent [19]

Nowakowski

[11] Patent Number: 5,260,709

[45] Date of Patent: Nov. 9, 1993

[54] AUTONOMOUS PRECISION WEAPON DELIVERY USING SYNTHETIC ARRAY RADAR

[75] Inventor: Michael V. Nowakowski, Los Angeles, Calif.

[73] Assignee: Hughes Aircraft Company, Los Angeles, Calif.

[21] Appl. No.: 810,630

[22] Filed: Dec. 19, 1991

[51] Int. Cl.[5] ..... G01S 13/66; G01S 13/90

[52] U.S. Cl. ..... 342/62; 342/64; 342/95; 342/97; 342/357; 342/25; 244/3.2

[58] Field of Search ..... 342/62, 63, 64, 95, 342/97, 357, 25; 244/3.2

[56] References Cited

U.S. PATENT DOCUMENTS

| | | | |
|---|---|---|---|
| 4,179,693 | 12/1979 | Evans et al. | 342/64 |
| 4,204,210 | 5/1980 | Hose | 342/25 |
| 4,315,609 | 2/1982 | McLean et al. | 244/3.14 |
| 4,495,580 | 1/1985 | Keearns | 364/450 |
| 4,549,184 | 10/1985 | Boles et al. | 342/25 |
| 4,578,678 | 3/1986 | Hurd | 342/357 |
| 4,589,610 | 5/1986 | Schmidt | 244/3.19 |
| 4,613,864 | 9/1986 | Hofgen | 342/357 |
| 4,741,245 | 5/1988 | Malone | 89/41.03 |
| 4,783,744 | 11/1988 | Yueh | 364/454 |
| 4,825,213 | 4/1989 | Smrek | 342/25 |
| 4,914,734 | 4/1990 | Love et al. | 342/64 |
| 4,949,089 | 8/1990 | Ruszkowski, Jr. | 342/52 |
| 4,959,656 | 9/1990 | Kumar | 342/418 |
| 5,018,218 | 5/1991 | Peregrim et al. | 382/22 |
| 5,047,777 | 9/1991 | Metzdorff et al. | 342/64 |
| 5,113,193 | 5/1992 | Powell et al. | 342/25 |
| 5,175,554 | 12/1992 | Mangiapane et al. | 342/149 |

*Primary Examiner*—John B. Sotomayor
*Attorney, Agent, or Firm*—L. A. Alkov; W. K. Denson-Low

[57] ABSTRACT

A system and method that uses differential computation of position relative to a global positioning system (GPS) coordinate system and the computation of an optimum weapon flight path to guide a weapon to a non-moving fixed or relocatable target. The system comprises an airborne platform that uses a navigation subsystem that utilizes the GPS satellite system to provide the coordinate system and a synthetic array radar (SAR) to locate desirable targets. Targeting is done prior to weapon launch, the weapon therefore requires only a navigation subsystem that also utilizes the GPS satellite system to provide the same coordinate system that the platform used, a warhead and a propulsion system (for powered weapons only). This results in a very inexpensive weapon with a launch and leave (autonomous) capability. The computational procedure used in the platform uses several radar measurements spaced many degrees apart. The accuracy is increased if more measurements are made. The computational algorithm uses the radar measurements to determine the point in a plane where the target is thought to be and the optimum flight path through that point. The weapon is flown along the optimum flight path and the impact with the ground results in a very good CEP when a sufficient number of radar measurements are made. The present invention provides fully autonomous, all-weather, high precision weapon delivery while achieving a relatively low cost. High precision weapon guidance is provided by the unique differential guidance technique (if a sufficiently accurate and stable navigation system is used).

13 Claims, 4 Drawing Sheets

AUTONOMOUS PRECISION WEAPON DELIVERY USING SYNTHETIC ARRAY RADAR

BACKGROUND

The present invention related to guidance systems, and more particularly, to a method and apparatus for providing autonomous precision guidance of airborne weapons.

Although many of the weapons utilized during the Desert Storm conflict were remarkably effective, this exercise demonstrated the limited usefulness of the current weapon inventory in adverse weather conditions. Because of the integral relationship between sensors (for targeting) and weapons, it's logical to look at a radar sensor to help resolve the adverse weather problem. Radar SAR (synthetic array radar) targeting has been employed for many years, but never with the consistently precise accuracies demonstrated by TV, FLIR and laser guided weapons in Desert Storm. High resolution radar missile seekers have been in development for several years; however, these concepts still represent much more technical risk and cost than the Air Force can bear for a near-term all-weather, precision guided munition.

Therefore it is an objective of the present invention to provide an autonomous precision weapon guidance system and method for use in guiding of airborne weapons, and the like.

SUMMARY OF THE INVENTION

The invention comprises a system and method that uses a differential computation of position relative to a launching aircraft and then computes an optimum weapon flight path to guide a weapon payload to a non-moving fixed or relocatable target. The invention comprises a radar platform having synthetic array radar (SAR) capability. The weapon comprises an inertial navigational system (INS) and is adapted to guide itself to a target position. Since the weapon does not require its own seeker to locate the target, or a data link, the weapon is relatively inexpensive. The present invention uses the radar to locate the desired targets, so that long standoff ranges can be achieved. Once the weapon is launched with the appropriate target coordinates, it operates autonomously, providing for launch-and-leave capability.

The targeting technique employs the SAR radar on board the launching aircraft (or an independent targeting aircraft). Operator designations of the target in two or more SAR images of the target area are combined into a single target position estimate. By synchronizing the weapon navigation system with the radar's navigation reference prior to launch, the target position estimate is placed in the weapon's coordinate frame. Once provided the target position coordinates, the weapon can, with sufficient accuracy in its navigation system (GPS aided navigation is preferred), guide itself to the target with high accuracy and with no need for a homing terminal seeker or data link.

The present invention relies on a very stable coordinate system to be used as a radar reference. One good example is the performance provided by the GPS navigational system. The GPS navigational system uses four widely spaced satellites. The GPS receiver uses time of arrival measurements on a coded waveform to measure the range to each of the four satellites. The receiver processes the data to calculate its position relative to the earth. Most position errors are caused by non-compensated errors in the models for transmission media (ionosphere and troposphere). If the GPS receiver moves a small distance, the media transmission errors are still approximately the same; therefore the GPS receiver can measure that distance change very accurately. As a result, the position and velocity estimates for the launching aircraft carrying a GPS receiver experiences very little drift over a period of several minutes or more. This stability is more difficult and expensive to achieve with other navigation systems.

The SAR radar measures the coordinates of the target relative to the launching aircraft. Therefore, the target position is known in the same coordinate frame as the radar. If the weapon's navigation system is synchronized and matched with the radar's navigation system reference, the target position is also in the weapon's coordinate system. An effective way of synchronizing the radar reference and the weapon navigation system is to use GPS receivers on the weapon and in the launching aircraft. If the weapon is commanded to operate using the same GPS constellation (nominally four satellites) as the radar, the weapon will navigate in the same coordinate frame as the radar (and the target) without requiring a transfer align sequence between the aircraft and the weapon INS. This use of relative, or differential, GPS eliminates the position bias inherent in the GPS system. In addition, the accuracy requirements of the INS components on the weapon are less stringent and therefore less expensive. However, if the weapon INS is sufficiently accurate and a transfer align procedure is exercised in an adequately stable environment, this approach can be used for an inertially-guided weapon without GPS aiding and provide approximately equivalent performance.

When the operator designates a pixel in the SAR image corresponding to the target, the radar computes the range and range rate of that pixel relative to the aircraft at some time. Since the radar does not know the altitude difference between the target and the platform, the target may not be in the image plane of the SAR map. As a result, the target's horizontal position in the SAR image may not correspond to its true horizontal position. Although the range and range rate are computed correctly, altitude uncertainty results in a potentially incorrect estimate of the target's horizontal position. The present invention removes this error by computing a flight path in the vicinity of the ground plane which causes the weapon to pass through the correct target point independent of the altitude error.

The present invention thus provides a highly accurate but relatively inexpensive weapon system. It has a launch-and-leave capability that enables a pilot to perform other duties (such as designating other targets) instead of weapon guidance. The launch-and-leave capability of the present invention requires only that the pilot designate the target on a SAR image once; the weapon system performs the remainder of the functions without further pilot intervention. The pilot can then designate other targets on the same image or other images and multiple weapons may be launched simultaneously. The pilot can then exit the target area.

The present invention therefore provides fully autonomous, all-weather, high precision weapon guidance while achieving a very low weapon cost. High precision weapon guidance is provided by the unique differential guidance technique (if a sufficiently accurate and stable navigation system is used). The present invention provides for a weapon targeting and delivery technique which (1) is very accurate (10–20 ft. CEP (Circular Error Probability)); (2) suffers no degradation in performance or utility in adverse weather conditions (smoke, rain, fog, etc.); (3) is applicable to non-moving relocatable targets (no extensive mission planning required); (4) supports a launch and leave (autonomous) weapon; (5) supports long stand-off range; (6) may be applied to glide or powered weapons; and (7) requires a relatively inexpensive weapon.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
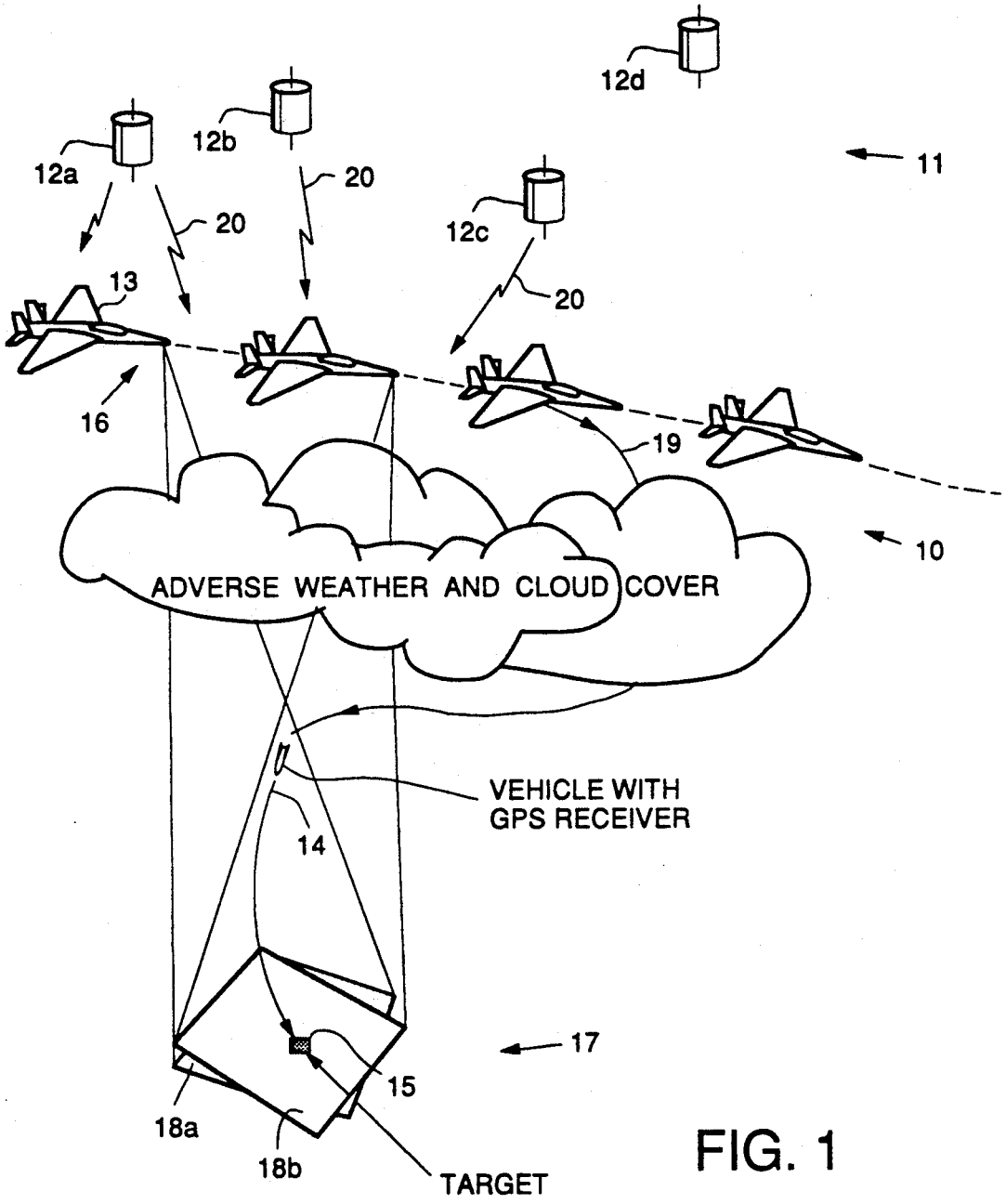
FIG. 1 is a diagram illustrating a weapon guidance system in accordance with the principles of the present invention shown in an operational environment.

Referring to the drawing figures, FIG. 1 is a diagram illustrating a weapon delivery system 10 in accordance with the principles of the present invention, shown in an operational environment. The weapon delivery system 10 is shown employed in conjunction with the global positioning system (GPS) 11 that employs four satellites 12*a*–12*d* that are used to determine the position of an airborne platform 13, or aircraft 13, having a deployable weapon 14. Both the aircraft 13 and the deployable weapon 14 have compatible inertial guidance systems (shown in FIG. 2) that are used to control the flight of the weapon 14.

As is shown in FIG. 1, the aircraft 13 flies over the earth, and a non-moving target 15 is located thereon. The aircraft 13 has a synthetic array radar (SAR) 16 that maps a target area 17 on the earth in the vicinity of the target 15. This is done a plurality of times to produce multiple SAR maps 18*a*, 18*b* of the target area 17. At some point along the flight path of the aircraft 13, subsequent to weapon flight path computation, the weapon 14 is launched and flies a trajectory 19 to the target area 17 that is computed in accordance with the present invention. Global positioning satellite system data 20 (GPS data 20) is transmitted from the satellites 12*a*–12*d* to the aircraft 13 prior to launch, and to the weapon 14 during its flight. Inertial reference data derived from the global positioning satellite system 11 is transferred to the weapon 14 prior to launch along with target flight path data that directs the weapon 14 to the target 15.

Figure 2:
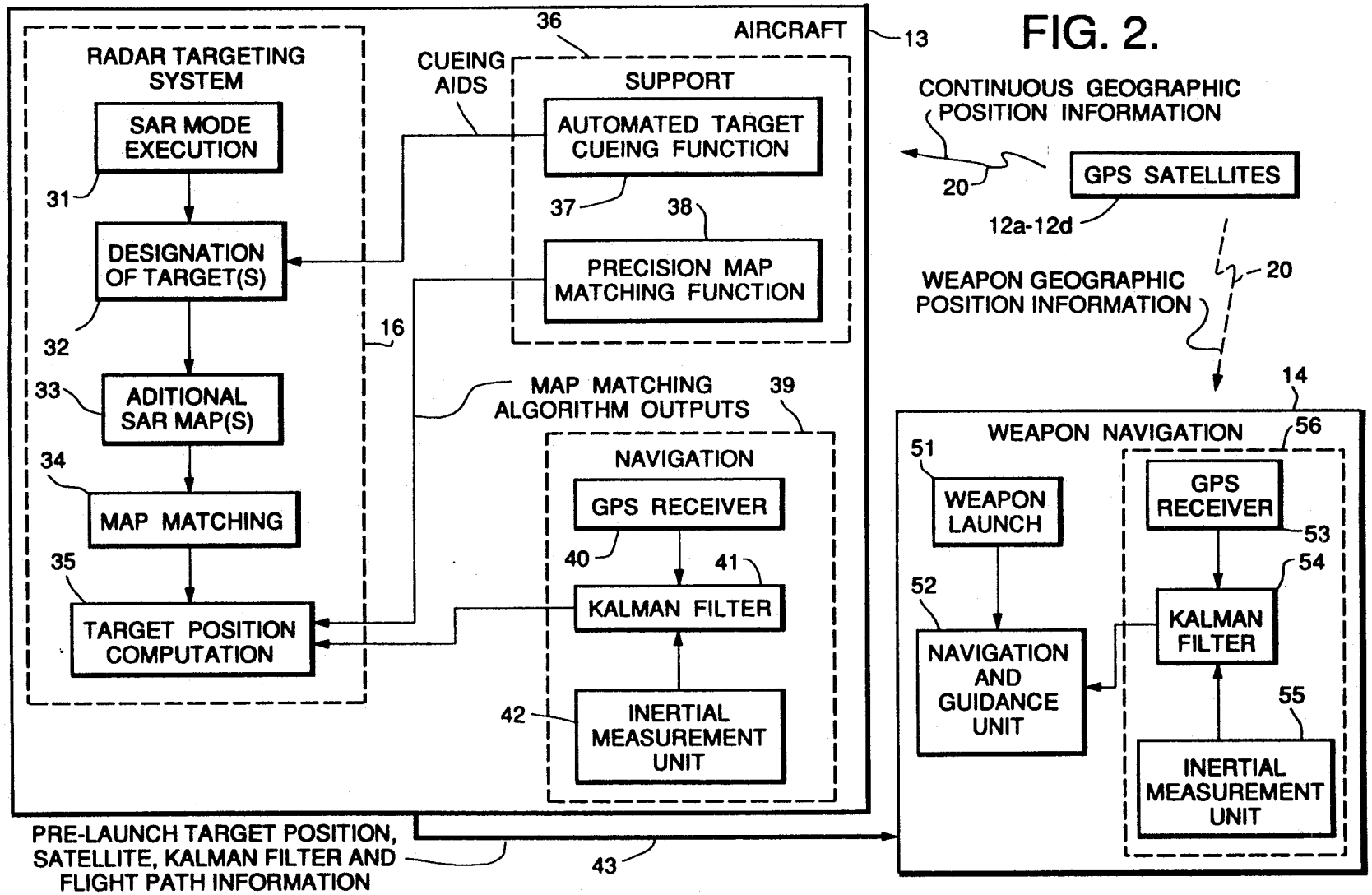
FIG. 2 is a block diagram of the system architecture of the system of FIG. 1.

FIG. 2 is a block diagram of the system architecture of the weapon delivery system 10 of FIG. 1. The weapon delivery system 10 comprises the following subsystems. In the aircraft 13 there is a radar targeting system 16 that includes a SAR mode execution subsystem 31 that comprises electronics that is adapted to process radar data to generate a SAR image. The SAR mode execution subsystem 31 is coupled to a target designation subsystem 32 that comprises electronics that is adapted to permit an operator to select a potential target located in the SAR image. The target designation subsystem 32 is coupled to a SAR map selection subsystem 33 that determines the number of additional maps that are required for target position computation. The SAR map selection subsystem 33 is coupled to a map matching subsystem 34 that automatically ensures that subsequent SAR maps 18*b* are correlated to the first SAR map 18*a*, so that the target designated in each subsequent map 18*b* is the same target designated in the first map 18*a*. The map matching subsystem 34 is coupled to a target position computation subsystem 35 that computes the target position and the optimum flight path 19 to the target 15 that should be flown by the weapon 14.

A support function subsystem 36 is provided that provides for automated target cueing 37 and precision map matching 38, whose outputs are respectively coupled to the target designation subsystem 32 and the target position computation subsystem 35. A navigation subsystem 39 is provided that comprises a GPS receiver 40 that receives data from the global positioning system 11, an inertial measuring unit (IMU) 42 that measures aircraft orientation and accelerations, and a Kalman filter 41 that computes the platform's position and velocity. The output of the Kalman filter 41 is coupled to the target position computation subsystem 35. The system on the aircraft 13 couples pre-launch data such as target position, the GPS satellites to use, Kalman filter initialization parameters and weapon flight path information 43 to the weapon 14 prior to its launch.

The weapon 14 comprises a weapon launch subsystem 51 that is coupled to a navigation and guidance unit 52 that steers the weapon 14 to the target 15. A navigation subsystem 55 is provided that comprises a GPS receiver 53 that receives data from the global positioning system 11, an inertial measuring unit (IMU) 56 that measures weapon orientation and accelerations, and a Kalman filter 54 that computes the weapon's position and velocity. The output of the Kalman filter 54 is coupled to the navigation and guidance unit 52 that guides the weapon 14 to the target 15.

In operation, the present weapon delivery system 10 relies on a stable coordinate system that is used as the radar reference. One good example is the performance provided by the GPS navigational system 11. The GPS navigational system 11 uses the four widely spaced satellites 12*a*–12*d*. The GPS receiver 40 in the aircraft 13 uses time of arrival measurements on a coded waveform to measure the range to each of the four satellites 12*a*–12*d*. The receiver 40 processes the data to calculate its position on the earth. Most of the errors in position are caused by noncompensated errors in the models for the transmission mediums (ionosphere and troposphere). If the GPS receiver 40 moves a small distance, the medium transmission errors are still approximately the same; therefore the GPS receiver 40 can measure that distance change very accurately. As a result, the position and velocity estimates for the aircraft 13 carrying the GPS receiver 40 experiences very little drift over a period of several minutes or more. This stability is more difficult and expensive to achieve with other navigation systems.

The radar targeting system 16 computes the coordinates of the target 15 relative to the aircraft 13. Therefore, the target 15 position is known in the same coordinate frame that the radar 16 uses. The weapon's navigation system 55 is synchronized and matched with the radar's navigation system 39, and therefore the position of the target 15 will also be in the weapon's coordinate system. An effective way of synchronizing the radar's navigation system 39 and the weapon's navigation system 55 is to command the weapon to operate using the same GPS constellation (nominally four satellites 12*a*–12*d*) as the radar, the weapon 14 then will navigate in the same coordinate frame as the radar 16 (and the target 15). This use of relative, or differential GPS eliminates the position bias inherent in the GPS system.

When the operator designates a pixel in the SAR image corresponding to the target 15, the radar targeting system 16 computes the range and range rate of that pixel relative to the aircraft 13 at some time. Since the radar targeting system 16 does not know the altitude difference between the target 15 and the platform 13, the target 15 may not be in the image plane of the SAR map 18. As a result, the target's horizontal position in the SAR image 18 may not correspond to its true horizontal position. Although the range and range rate are computed correctly, altitude uncertainty results in a potentially incorrect estimate of the target's horizontal position. The present invention removes this error by computing a flight path 19 in the vicinity of the ground plane which causes the weapon 14 to pass through the true target 15 plane independent of the altitude error.

The details of the implemented computational procedures used in the present invention is described in detail in the attached Appendix. The target estimation algorithm optimally combines the radar measurements with navigation estimates to arrive at the target location in the radar's navigation coordinate system.

A more detailed description of the operation of the weapon delivery system 10 is presented below. The weapon delivery system 10 uses the stability of the GPS navigational system 11 to provide accurate platform location for weapon delivery. The GPS navigational system 11 is comprised of four widely spaced satellites 12*a*–12*d* that broadcast coded transmissions used by the aircraft's GPS receiver 40 to compute the aircraft location and velocity with great precision. While the GPS navigational system 11 provides position measurements with a very small variance, the position bias may be significant. However, most of the bias in GPS position estimates are caused by uncompensated errors in the atmospheric models. If the GPS receiver 40 traverses small distances (e.g., 40 nautical miles), the effects of the atmospheric transmission delays remain relatively constant. Therefore, the GPS receiver 40 can determine its location in the biased coordinate frame with great precision. Since the location of the target 15 is provided by the radar 16 in coordinates relative to the aircraft 13 and the weapon 14 uses the same displaced coordinate system, the effect of the GPS position bias is eliminated. Therefore, the weapon delivery system 10 may use the GPS system 11 to provide highly accurate targeting and weapon delivery.

Using the weapon delivery system 10 is a relatively simple process. FIG. 1 shows the typical targeting and weapon launch sequence for the weapon delivery system 10. As the aircraft 13 passes near the target 15, the operator performs a high resolution SAR map 18*a* (approximately 10 feet) of the target area 17. Once the operator has verified the target 15 as a target of interest, the operator designates the target 15 with a cursor. To improve the accuracy of the weapon delivery, the operator performs one or more additional maps 18*b* of the target area 17 from a different geometric orientation. The weapon delivery system 10 automatically correlates the additional map 18*b* (or maps) with the initial map 18*a* used for target designation. The target position information from all the maps is used by the model (computational process) to compute a more precise target location in the relative GPS coordinate system. Typically, only one additional map 18*b* is necessary to provide sufficient target position accuracy for the high precision weapon delivery. The operator then launches the weapon 14 against the designated target 15. The navigation and guidance unit 52 in the weapon 14 guides it on the optimum flight path 19 to ensure accuracy.

There are five key features that make this weapon delivery system 10 superior to other weapon delivery systems. The first and primary feature of the weapon delivery system 10 is its autonomous, all-weather weapon delivery capability. This feature alone provides many benefits over conventional weapon delivery systems. Once the weapon 14 is launched, no post-launch aircraft support is necessary to ensure accurate weapon delivery. The second major feature of the weapon delivery system 10 is the elimination of the need for weapons 14 containing sensors. The elimination of sensors allows substantial financial savings in weapon costs. The third major feature of the weapon delivery system 10 is that the operator (pilot) is required to designate the target 15 only once. This not only reduces pilot workload and allows the pilot to maintain situational awareness, but also reduces errors caused by not designating the same point in subsequent maps. A fourth feature of the weapon delivery system 10 is its versatility. The weapon delivery system 10 may be used to deliver guide bombs or air to ground missiles, for example. A fifth benefit of the weapon delivery system 10 is its differential GPS guidance algorithm. Since the weapon 14 is guided using a GPS aided navigational system 11, an all weather precision accuracy of 10–15 ft is achievable. A more accurate weapon 14 allows the use of smaller, less expensive warheads which allows the platform 13 to carry more of them and enhance mission capability.

The block diagram of the weapon delivery system 10 is shown in FIG. 2. This figure outlines the functional elements of the weapon delivery system 10 as well as the operational procedure necessary to use the system 10. The weapon delivery system 10 requires three basic elements. These three elements include the GPS satellite system 11, the radar targeting system 16, and the weapon 14 containing a GPS aided navigation system 55. These aspects of the weapon delivery system 10 are described in greater detail below.

The GPS satellite system 11 is comprised of the four satellites 12*a*–12*d* which broadcast coded waveforms which allow the GPS receivers 40, 53 in the aircraft 13 and in the weapon 14 to compute their locations in the GPS coordinate frame. The SAR platform 13, or aircraft 13, contains a GPS aided navigation subsystem 39 and a radar targeting system 16 with a high-resolution SAR capability. The SAR platform 13 detects the target 15 and computes the weapon flight path 19 to deliver the weapon 14 to the target 15. The weapon 14 receives pre-launch target position information from the SAR platform 13 and uses its own GPS aided navigation system 55 to autonomously navigate to the target location.

As is illustrated in FIG. 2, the operation of the weapon delivery system 10 is comprised of seven basic steps. The first step is target detection. As the SAR platform 13 approaches the target area 17, the operator commands the SAR mode to perform a high resolution map 18*a* of the desired target area 17. The second step is target designation. Once the operator has verified that the detected target 15 is a target of interest, the operator designates the target 15 with a cursor. The third step is to acquire additional SAR maps 18*b* of the target from different target angles. These additional maps allow the weapon delivery system 10 to compute the target position more accurately. The number of maps necessary to achieve a specific CEP requirement varies with the geometry at which the SAR maps 18 are obtained. However, in general, only one or two additional maps 18*b* are required to achieve a 10–15 foot CEP.

The fourth event in the weapon delivery system 10 operational scenario is map matching. The weapon delivery system 10 automatically correlates the images of the additional SAR maps 18*b* with the original SAR map 18*a* to eliminate the need for repeated operator target designation. The fifth step is to compute the target position and the weapon flight path 19 through that position. The target position information from all the maps is used by the weapon delivery system 10 to compute a more precise target location in the relative GPS coordinate system. The sixth step is comprised of the automatic loading of the pre-launch weapon information. The weapon 14 receives flight path information, navigation initialization information, and target position information prior to launch. The seventh event in the weapon delivery system 10 operational scenario is weapon launch. Once the pre-launch information has been loaded into the weapon 14, the operator is free to launch the weapon 14 against the designated target 15. The weapon's GPS aided navigation system 55 automatically acquires the same GPS satellites 12*a*–12*d* used by the aircraft 13 for navigation and the weapon's navigation and guidance unit 52 then guides the weapon 14 to the target 15 based on the flight path information computed by the SAR platform 13.

Most of the processing required for the weapon delivery system 10 takes place on the SAR platform 13. The SAR platform 13 contains the GPS aided navigation system 39 for aircraft position and velocity computation as well as the radar targeting system 16 which determines the position of the target 15 with respect to the aircraft 13. The processing which occurs on the SAR platform 13 may be summarized in five steps: (1) SAR mode execution: initial detection of the desired target 15. (2) Target designation: operator designation of the target of interest. (3) Additional SAR maps: additional SAR maps 18*b* of target area 17 to provide improved target position accuracy. (4) Automated map matching: automatic matching of additional maps 18 to ensure accurate target designation. (5) Target position computation: computation of target position based on the position and velocity estimates of the aircraft 13 and SAR map measurements. Each of these five processing steps are discussed in detail below.

The first step in the use of the weapon delivery system 10 in the SAR mode execution. The initial SAR mode execution provides the operator with a SAR image of the target area 17. The operator may perform several low resolution maps 18 of the target area 17 before performing a high resolution map of the target 15. Only high resolution maps 18 of the target area 17 are used as an initial map in the weapon delivery system 10 since small CEPs are desirable for weapon delivery. Therefore, all SAR maps 18 used for targeting typically have pixel sizes of 10 feet or less.

Once the operator has verified the target 15 as a target of interest, the operator designates the target 15 with a cursor. Although multiple SAR maps 18 are made to ensure precision weapon delivery, the operator only needs to designate the target 15 once. To aid in target designation, a library of target templates is provided. This target template library, part of the target cueing function 37, provides the operator with an image of what the target 15 should look like and which target pixel should be designated. The target cueing function 37 provides the templates to assist the operator in targeting and designation. The computer-aided target cueing function 37 not only aids the operator in designating the correct target 15, but also minimizes the designation error by providing a zoom capability.

After the operator has designated the target 15, additional high resolution SAR maps of the target 15 must be performed to improve the accuracy of the target position computation. These addition maps should be performed at a different orientation with respect to the target 15. As more maps of the target 15 are obtained from different geometric aspects, the accuracy of the computed position increases. Typically only one additional map 18 is necessary to achieve a small CEP (~10–15 feet). However, the requisite number of additional maps 18 required to achieve a small CEP will vary according to a number of factors including target-to-aircraft geometry, SAR map resolution, platform velocity, and platform altitude.

Once additional maps 18 of the designated target 15 are performed, the operator is not required to designate the targets 15 in the new images. Instead, the weapon delivery system 10 performs high precision map matching to accurately locate the same designated target 15 in the additional SAR maps 18. The map matching algorithm used to designate the targets 15 in the subsequent images is provided by the precision map-matching function 38. The high precision map matching function 38 automatically determines the coordinate transformations necessary to align the two SAR images. While the accuracy of the matching algorithm may vary with image content and size, subpixel accuracy is possible with images of only modest contrast ratio.

Figure 3:
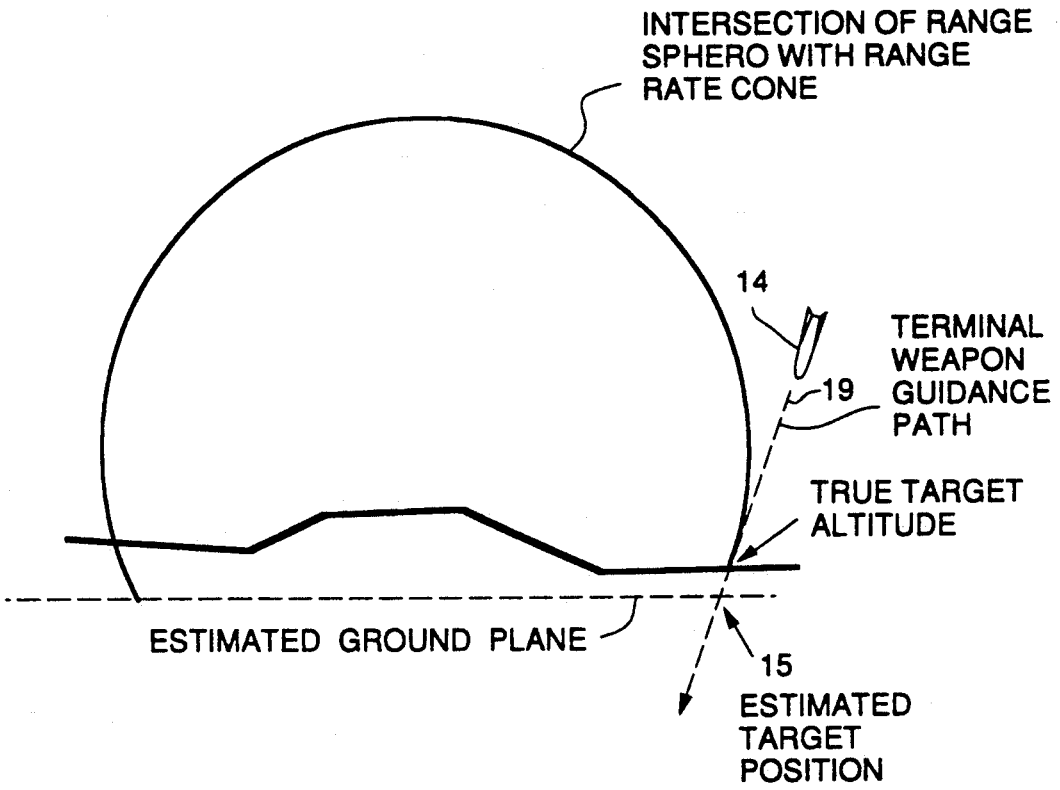
FIG. 3 shows the terminal weapon guidance path computed in accordance with the principles of the present invention.

The target estimation algorithm combines all of the SAR radar measurements with the aircraft navigation position and velocity estimates to obtain the target location in the relative GPS coordinate system. The outputs of the platform's GPS receiver 40 and IMU 42 are processed by the Kalman filter 41 and the outputs of the Kalman filter 41 are extrapolated to the time the SAR map 18 was formed to determine the position and velocity vectors to associate with the SAR image data. Once the map matching procedure is completed and all SAR target measurements are performed, the parameters of the target designated by the operator are computed in the GPS coordinate system consistent with the GPS system 11. After the target location is computed, the weapon delivery system 10 computes an optimal weapon flight path 19 to ensure precise weapon delivery. The flight path 19 of the weapon that is computed by the weapon delivery system 10 is the best flight path through the estimated target position. If the missile is flown along this path, it is guaranteed to intersect the target plane near the target regardless of the actual altitude of the target, as is illustrated in FIG. 3.

Before weapon launch, the weapon delivery system 10 downloads the computed flight path into the weapon's navigation and guidance unit 52. The system 10 also downloads the coefficients necessary for the weapon to initialize its navigation subsystem 55 to eliminate any initial errors between the SAR platform's navigation system 39 and the weapon's navigation system 55. Additionally, the SAR platform 13 provides the weapon 14 with information regarding which GPS satellites 12a–12d to use for position computation. Use of the same GPS satellites 12a–12d for aircraft and weapon position determination ensures the same precise differential GPS coordinate system is used for both the weapon 14 and the aircraft 13. Other information the weapon receives prior to launch includes the target position. Once the initialization parameters are received from the SAR platform 13 and the weapon 14 initializes its navigation subsystem 55, the weapon 14 is ready for launch.

After launch, the navigation subsystem 55 in the weapon 14 is used by the navigation and guidance computer 52 to guide the weapon 14 along the pre-computed flight path 19 to the target 15. After launch, no communications between the weapon 14 and the SAR platform 13 are necessary. The SAR platform 13 is free to leave the target area 17.

To determine the accuracy of the weapon delivery system 10, the basic error sources must first be identified. In general, there are two sets of error sources which can degrade the accuracy of weapon delivery using the weapon delivery system 10. The first set are the errors associated with the radar targeting system 16. These errors include errors in the aircraft position and velocity data from the navigation system 39, errors in the radar measurements (range and range rate) from the SAR mode 31, and errors associated with the designation function 32. The second set of errors are associated with the navigation and guidance errors of the weapon 14. The navigation errors are associated with incorrect position estimates of the weapon's navigation subsystem 55. The guidance errors are associated with not guiding the weapon 14 along the correct flight path 19 (e.g., due to wind) by the navigation and guidance unit 52 of the weapon 14.

Given the navigation subsystem 39 position and velocity estimate accuracies and the SAR mode measurement accuracies, the accuracy of the weapon delivery system 10 may be analyzed. The accuracy of the weapon delivery system 10 also depends upon the accuracy of the designation and the weapon's ability to navigate to the target 15 along the computed flight path 19. The more measurements that are made, the lower the variance of the estimated target position. To reduce the target position error, each SAR target position measurement is optimally combined in a filter to exploit the full benefits of multiple target detections.

Figure 4:
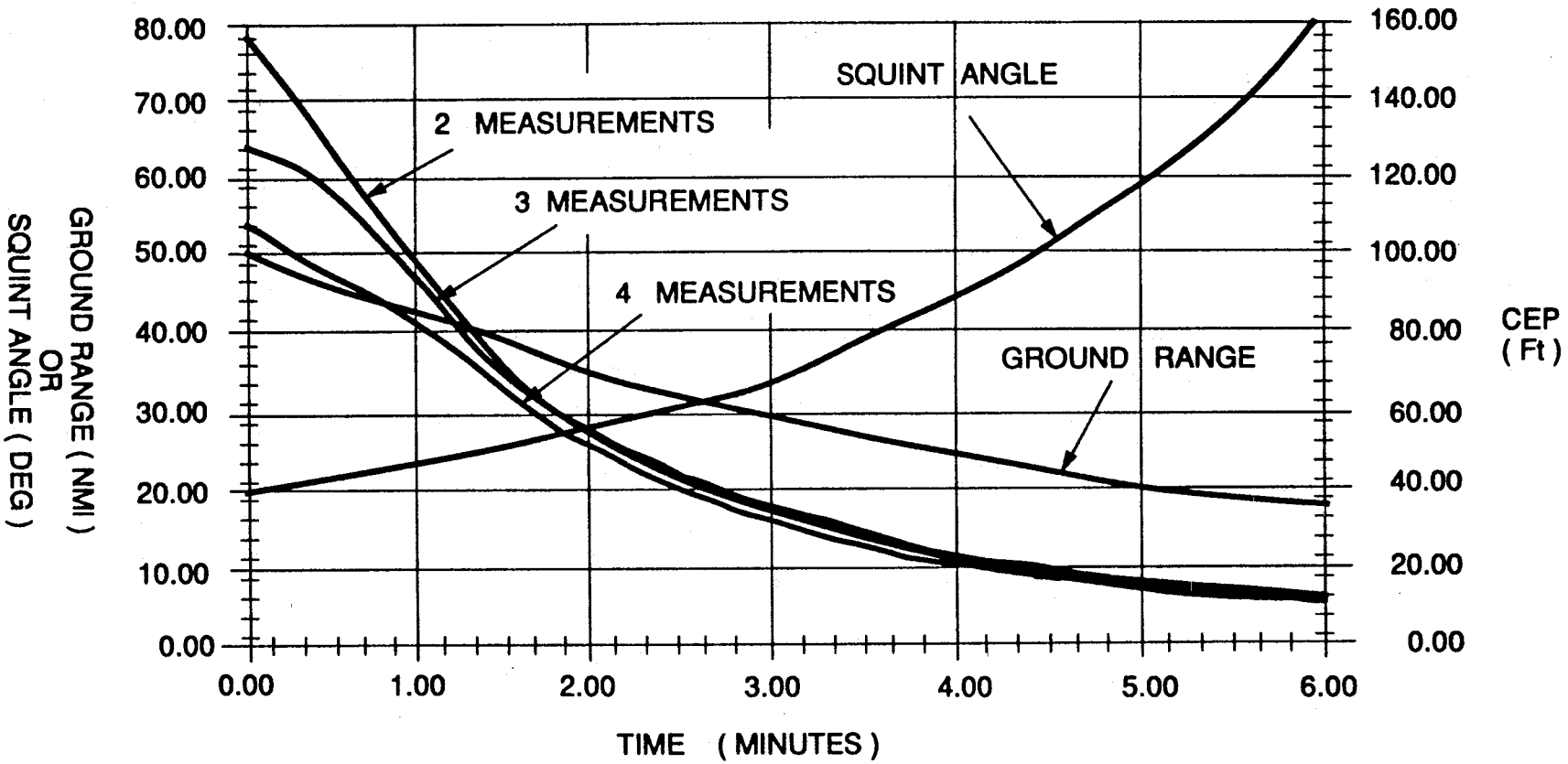
FIG. 4 shows an example of the performance that is achievable with the system of the present invention for a 50 nautical mile range to a target.

FIG. 4 shows the targeting performance of the weapon delivery system 10 when the SAR platform 13 is flying in a straight line path toward the target 15 from an initial range of 50 nautical miles and squint angle of 20 degrees. For the targeting performance chart shown in FIG. 4, the horizontal axis represents the elapsed time for the last measurement since the first SAR map 18 was performed (measurements are made at equal angles). The speed of the aircraft 13 is assumed to be 750 feet per second and the altitude is 45,000 feet. The left vertical axis represents the squint angle in degrees or the ground range to the target 15 in nautical miles. The right vertical axis represents the CEP in feet. The performance of FIG. 4 assumes the following values for the error sources:

a radar navigation position error of 1.29 feet (1 $\sigma$), a radar navigation velocity error of 0.26 feet/second (1 $\sigma$), and a radar range measurement error of $\sigma_r^2(n)$.

The radar range rate measurement error $\sigma_r^2(n)$ is given by $$\sigma_r^2(n) = \left(\frac{r(n)}{38411}\right)^2 + 25,$$

where r(n) is the range at time n.

Thus, the radar range rate measurement error is $$\sigma_r^2(n) = \left(\frac{v(n)}{36583}\right)^2 + 12.5\,\frac{750^2 - v(n)^2}{r(n)^2},$$

where v(n) is the range rate at time n, the designation error is 4 feet (CEP), the weapon navigation error is 5 feet (CEP), and the weapon guidance error is 3 feet (CEP).

For the 50 nautical mile case shown in FIG. 4, the weapon delivery system 10 can achieve a 14 foot CEP by making a second measurement 5 minutes after the first. At this point the aircraft 13 has flown through an angle of 40 degrees and is 20 nautical miles from the target. Making more than two measurements does not improve the CEP very much. The time required to make these extra measurements is better utilized by imaging other target areas. Performance of this weapon delivery system 10 depends only on the location of the SAR platform 13 relative to the target 15 when the measurements are made and is independent of the aircraft flight path used to get the SAR platform 13 to those measurement locations.

Thus there has been described a new and improved method and apparatus for providing autonomous precision guidance of airborne weapons. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

APPENDIX

The details of the implemented algorithms used in the present invention will be described below. The target estimation algorithm optimally combines the radar measurements with the navigation estimates to arrive at the target location in the radar's navigation coordinate system. The algorithm consists of two parts: (1) Compute the horizontal target position for a fixed ground plane; and (2) Generalize the horizontal position for a variable ground plane.

First part: fixed ground plane. The first part of the algorithm assumes the target is in a chosen ground plane such as the image plane. An estimate of the target (x,y) position in this ground plane is determined by a weighted least squares algorithm using each of the radar measurements. The ($x_t$, $y_t$) ($z_t$ defines the ground plane) value that minimizes the following function is used as this estimate.

$$F(x_t,y_t) = \sum_{n=1}^{N} \left( \frac{R_e(n) - r(n)}{\sigma_1(n)} \right)^2 + \left( \frac{V_e(n) - v(n)R_e(n)}{\sigma_2(n)} \right)^2$$

where $R_e(n)=\sqrt{[x(n)-x_t]^2+[y(n)-y_t]^2+[z(n)-z_t]^2}$, $V_e(n)=v_x(n)\ [x(n)-x_t]+v_y(n)\ [y(n)-y_t]+v_z(n)\ [z(n)-z_t]$, N is the number of radar measurements performed, x(n), y(n) and z(n) is the estimated navigation position vector at time n, $v_x(n)$, $v_y(n)$ and $v_z(n)$ is the estimated navigation velocity vector at time n, r(n) is the measured range to the target at time n, v(n) is the measured range rate to the target at time n, and $\sigma_1(n)$ and $\sigma_2(n)$ are the weights used for each radar measurement.

Derivation of weights. The first term uses the radar range measurement.

$$\text{Term (1)} = \sqrt{[x(n) - x_t]^2 + [y(n) - y_t]^2 + [z(n) - z_t]^2} - r(n)$$

The variance of the first term is used as the first weight. The variance is computed by expanding the first term in a Taylor series around the mean of the random variables. Notationally, a vertical line to the right of an expression in the following equations indicates that the expression is to be evaluated at the mean of each of the variables in that expression.

$$\text{Term (1)} \cong \frac{x(n) - x_t}{R_e(n)} \Big| [x(n) - x(n)] + \frac{y(n) - y_t}{R_e(n)} \Big| [y(n) - y(n)] + \frac{z(n) - z_t}{R_e(n)} \Big| [z(n) - z(n)] - [r(n) - r(n)]$$

where x(n) the mean of x(n), y(n) is the mean of y(n), z(n) the mean of z(n), and r(n) is the mean of r(n).

The expected value of Term (1) is zero; therefore the variance of the first term is calculated by taking the expected value of the square of Term (1). The random variables in this expression (x(n), y(n), z(n) and r(n)) are assumed to be independent of each other.

$$E\,(\text{Term (1)})^2 \cong s_1^2(n) = \frac{[x(n) - x_t]^2}{R_e(n)^2} \Big| \sigma_x^2(n) + \frac{[y(n) - y_t]^2}{R_e(n)^2} \Big| \sigma_y^2(n) + \frac{[z(n) - z_t]^2}{R_e(n)^2} \sigma_z^2(n) + \sigma_r^2(n)$$

where $\sigma_x^2(n)$ is the variance of x(n), $\sigma_y^2(n)$ is the variance of y(n), $\sigma_z^2(n)$ is the variance of z(n), $\sigma_r^2(n)$ is the variance of r(n). If the navigation system position errors are coordinate system and time independent ($\sigma_x^2(n)=\sigma_y^2(n)=\sigma_z^2(n)=\sigma_p^2$) then the weight used with Term (1) is the following: $\sigma_1^2(n)=\sigma_p^2+\sigma_r^2(n)$.

The second term uses the radar range rate measurement, v(n).

$$\text{Term (2)} = v_x(n)[x(n)-x_t]+v_y(n)\ [y(n)-y_t]+v_z(n)\ [z(n)-z_t]-v(n)\ R_e(n)$$

The variance of the second term is used as the second weight. It is computed by expanding the second term in a Taylor series around the mean of each of the random variables.

$$\text{Term (2)} \cong \left( v_x(n) - v(n)\frac{x(n) - x_t}{R_e(n)} \right) \Big| [x(n) - x(n)] + \left( v_y(n) - v(n)\frac{y(n) - y_t}{R_e(n)} \right) \Big| [y(n) - y(n)] + \left( v_z(n) - v(n)\frac{z(n) - z_t}{R_e(n)} \right) \Big| [z(n) - z(n)] + [x(n) - x_t] | [v_x(n) - v_x(n)] + [y(n) - y_t] | [v_y(n) - v_y(n)] + [z(n) - z_t] | [v_z(n) - v_z(n)] - R_e(n) | [v(n) - v(n)]$$

Since the expected value of the second term is also zero, the variance of the second term is calculated by taking the expected value of the square of Term (2). The random variables in this expression are assumed to be independent of each other.

$$E\,(\text{Term (2)})^2 \cong \sigma_2^2(n) = \left( v_x(n) - v(n)\frac{x(n) - x_t}{R_e(n)} \right)^2 \sigma_x^2(n) + \left( v_y(n) - v(n)\frac{y(n) - y_t}{R_e(n)} \right)^2 \sigma_y^2(n) + \left( v_z(n) - v(n)\frac{z(n) - z_t}{R_e(n)} \right)^2 \sigma_z^2(n) + [x(n) - x_t]^2\sigma_{vx}^2 + [y(n) - y_t]^2\sigma_{vy}^2(n) + [z(n) - z_t]^2\sigma_{vz}^2(n) + R_e(n)^2\sigma_r^2(n)$$

where $\sigma_{vx}^2(n)$ is the variance of $v_x(n)$, $\sigma_{vy}^2(n)$ is the variance of $v_y(n)$, $\sigma_{vz}^2(n)$ is the variance of $v_z(n)$, $\sigma_r^2(n)$ is the variance of v(n).

If the navigation system position errors and velocity errors are coordinate system and time independent ($\sigma_x^2(n)=\sigma_y^2(n)=\sigma_z^2(n)=\sigma_p^2$ and $\sigma_{vx}^2(n)=\sigma_{vy}^2(n)=\sigma_{vz}^2(n)=\sigma_v^2$) then the weight used with term (2) is the following:

$$\sigma_2^2(n) = \left( |\text{Velocity}|^2 - 2\frac{v(n)V_e(n)}{R_e(n)} + v\,(n)^2 \right)\sigma_p^2 + R_e(n)^2(\sigma_v^2 + \sigma_r^2(n))$$

Since $R_e(n)\cong r(n)$ and $V_e(n)\cong r(n)\ v(n)$, the weight that is used in the algorithm is the following:

$$\sigma_2^2(n)=(|\text{Velocity}|^2-v(n)^2)\ \sigma_p^2+r(n)^2\ (\sigma_v^2+\sigma_r^2(n))$$

Solving for $x_t$ and $y_t$. The two terms along with their variances are used in a weighted least squares problem. The problem is to find the $x_t$ and $y_t$ that minimizes the following function:

$$F(x_t,y_t) = \sum_{n=1}^{N} \left( \frac{R_e(n) - r(n)}{\sigma_1(n)} \right)^2 + \left( \frac{V_e(n) - v(n)R_e(n)}{\sigma_2(n)} \right)^2$$

where N is the number of radar measurements available. To minimize $F(x_t, y_t)$, values are found for $x_t$ and $y_t$ that result in the derivative of $F(x_t, y_t)$ with respect to both $x_t$ and $y_t$ being equal to zero. The derivatives of $F(x_t, y_t)$ with respect to $x_t$ and $y_t$ are determined and set equal to zero as follows:

$$\frac{\partial F(x_t,y_t)}{\partial x_t} = 2 \sum_{n=1}^{N} \frac{S(n)}{\sigma_1^2(n)} \frac{\partial S(n)}{\partial x_t} + \frac{T(n)}{\sigma_2^2(n)} \frac{\partial T(n)}{\partial x_t} = 0, \text{ and } \frac{\partial F(x_t,y_t)}{\partial y_t} =$$

$$2 \sum_{n=1}^{N} \frac{S(n)}{\sigma_1^2(n)} \frac{S(n)}{\partial y_t} + \frac{T(n)}{\sigma_2^2(n)} \frac{\partial T(n)}{\partial y_t} = 0$$

where $$S(n) = R_e(n) - r(n)$$

$$\frac{\partial S(n)}{\partial x_t} = -\frac{x(n) - x_t}{R_e(n)}$$

$$\frac{\partial S(n)}{\partial y_t} = -\frac{y(n) - y_t}{R_e(n)}$$

$$\frac{\partial^2 S(n)}{\partial x_t^2} = \frac{1}{R_e(n)} \left( 1 - \left( \frac{\partial S(n)}{\partial x_t} \right)^2 \right)$$

$$\frac{\partial^2 S(n)}{\partial y_t^2} = \frac{1}{R_e(n)} \left( 1 - \left( \frac{\partial S(n)}{\partial y_t} \right)^2 \right)$$

-continued $$\frac{\partial^2 S(n)}{\partial x_t \partial y_t} = -\frac{1}{r_e(n)} \frac{\partial S(n)}{\partial x_t} \frac{\partial S(n)}{\partial y_t}$$

$$T(n) = V_e(n) - v(n)R_e(n)$$

$$\frac{\partial T(n)}{\partial x_t} = -v_x(n) - v(n) \frac{\partial S(n)}{\partial x_t}$$

$$\frac{\partial T(n)}{\partial y_t} = -v_y(n) - v(n) \frac{\partial S(n)}{\partial y_t}$$

$$\frac{\partial^2 T(n)}{\partial x_t^2} = -\frac{v(n)}{R_e(n)} \left( 1 - \left( \frac{\partial S(n)}{\partial x_t} \right)^2 \right)$$

$$\frac{\partial^2 T(n)}{\partial y_t^2} = -\frac{v(n)}{R_e(n)} \left( 1 - \left( \frac{\partial S(n)}{\partial y_t} \right)^2 \right)$$

$$\frac{\partial^2 T(n)}{\partial x_t \partial y_t} = \frac{v(n)}{R_e(n)} \frac{\partial S(n)}{\partial x_t} \frac{\partial S(n)}{\partial y_t}$$

The solution for the two equations is found iteratively using a Taylor series expansion. The equation for $$\frac{\partial F(x_t,y_t)}{\partial x_t}$$

is expanded around the point $x_t = x_c$ and $y_t = y_c$ as follows:

$$\frac{\partial F(x_t,y_t)}{\partial x_t} = \frac{\partial f(x_t,y_t)}{\partial x_t}\Bigg|_{\substack{x_t=x_c \\ y_t=y_c}} + \frac{\partial^2 F(x_t,y_t)}{\partial x_t^2}\Bigg|_{\substack{x_t=x_c \\ y_t=y_c}} (x_t - x_c) + \frac{\partial^2 F(x_t,y_t)}{\partial x_t \partial y_t}\Bigg|_{\substack{x_t=x_c \\ y_t=y_c}} (y_t - y_c) = 0$$

where $$\frac{\partial^2 F(x_t,y_t)}{\partial x_t^2} = 2 \sum_{n=1}^{N} \frac{1}{R_e(n)} \left[ \frac{r(n)}{\sigma_1^2(n)} + \frac{V_e(n)v(n)}{\sigma_2^2(n)} \right] \left[ \left( \frac{\partial S(n)}{\partial x_t} \right)^2 - 1 \right] + \frac{1}{\sigma_1^2(n)} + \frac{v(n)^2 + v_x(n)^2 + 2v(n)v_x(n) \frac{\partial S(n)}{\partial x_t}}{\sigma_2^2(n)}$$

and $$\frac{\partial^2 F(x_t,y_t)}{\partial x_t^2} = 2 \sum_{n=1}^{N} \frac{1}{R_e(n)} \left[ \frac{r(n)}{\sigma_1^2(n)} \frac{V_e(n)v(n)}{\sigma_2^2(n)} \right] \frac{\partial S(n)}{\partial x_t} \frac{\partial S(n)}{\partial y_t} + \frac{v_x(n)v_y(n) + v(n) \left[ v_x(n) \frac{\partial S(n)}{\partial y_t} + v_y(n) \frac{\partial S(n)}{\partial x_t} \right]}{\sigma_2^2(n)}$$

The Taylor series expansion for the quation for $$\frac{\partial F(x_t,y_t)}{\partial x_t}$$

around the point $x_t = x_c$ and $y_t = y_c$ is as follows:

$$\frac{\partial F(x_t,y_t)}{\partial y_t} = \frac{\partial f(x_t,y_t)}{\partial y_t}\Bigg|_{\substack{x_t=x_c \\ y_t=y_c}} + \frac{\partial^2 F(x_t,y_t)}{\partial x_t \partial y_t}\Bigg|_{\substack{x_t=x_c \\ y_t=y_c}} (x_t - x_c) + \frac{\partial^2 F(x_t,y_t)}{\partial y_t}\Bigg|_{\substack{x_t=x_c \\ y_t=y_c}} (y_t - y_c) = 0$$

-continued where $$\frac{\partial^2 F(x_t,y_t)}{\partial y_t^2} = 2\sum_{n=1}^{N}\frac{1}{R_e(n)}\left[\frac{r(n)}{\sigma_1^2(n)}+\frac{V_e(n)v(n)}{\sigma_2^2(n)}\right]\left[\left(\frac{\partial S(n)}{\partial y_t}\right)^2-1\right]+$$

$$\frac{1}{\sigma_1^2(n)}+\frac{v(n)^2+v_y(n)^2+2v(n)v_y(n)\frac{\partial S(n)}{\partial y_t}}{\sigma_2^2(n)}$$

The problem has been reduced to finding the solution of two equations with two unknowns. The coefficients in the expansion are renamed and the solution is determined as follows:

$$a_{11}(x_t-x_c)+a_{12}(y_t-y_c)+a_x=0$$

$$a_{12}(x_t-x_c)+a_{22}(y_t-y_c)+a_y=0$$

where $$a_x=\frac{1}{2}\left.\frac{\partial F(x_t,y_t)}{\partial x_t}\right|_{\substack{x_t=x_c\\y_t=y_c}} a_y=\frac{1}{2}\left.\frac{\partial F(x_t,y_t)}{\partial y_t}\right|_{\substack{x_t=x_c\\y_t=y_c}}$$

$$a_{11}=\frac{1}{2}\left.\frac{\partial^2 F(x_t,y_t)}{\partial x_t^2}\right|_{\substack{x_t=x_c\\y_t=y_c}} a_{12}=\frac{1}{2}\left.\frac{\partial^2 F(x_t,y_t)}{\partial x_t\partial y_t}\right|_{\substack{x_t=x_c\\y_t=y_c}}$$

and $$a_{22}=\frac{1}{2}\left.\frac{\partial^2 F(x_t,y_t)}{\partial y_t^2}\right|_{\substack{x_t=x_c\\y_t=y_c}}$$

$$x_t=x_c+\frac{a_{12}a_y-a_{22}a_x}{a_{22}a_{11}-a_{12}^2}\,y_t=y_c+\frac{a_{12}a_x-a_{11}a_y}{a_{22}a_{11}-a_{12}^2}.$$

The initial value for ($x_c$, $y_c$) is determined by the target position in the first map (each pixel has an x-y coordinate value in the ground plane). The solution ($x_t$, $y_t$) is then used for ($x_c$, $y_c$) on the next iteration. The process is repeated until the derivatives $a_x$ and $a_y$ are very close to zero.

Second part: varying ground plane. The second part of the algorithm involves finding the best estimates ($x_t$, $y_t$) as a function of $z_t$. This curve defines the best flight path through the point determined in the first part of this algorithm that will minimize the target miss distance in the true target plane. The radar measurements and navigation estimates are again used to find this path. The equations for the point ($x_t$, $y_t$) in the ground plane ($z_t=z_c$) are expanded in a third order Taylor series as a function of altitude. The equations for this point are as follows:

$$x_t=x_c+\frac{a_{12}a_y-a_{22}a_x}{a_{22}a_{11}-a_{12}^2}\,y_t=y_c+\frac{a_{12}a_x-a_{11}a_y}{a_{22}a_{11}-a_{12}^2}.$$

Taylor series expansion in z: linear terms. The linear terms of the Taylor series expansion are found by taking the derivative of each of the equations with respect to $z_t$.

$$\frac{dx_t}{dz_t}=\frac{dx_c}{dz_t}+$$

-continued $$\frac{a_{12}\frac{da_y}{dz_t}=a_y\frac{da_{12}}{dz_t}-a_{22}\frac{da_x}{dz_t}-a_x\frac{da_{22}}{dz_t}}{A}-\frac{a_{12}a_y-a_{22}a_x}{A^2}\frac{dA}{dz_t}$$

$$\frac{dy_t}{dz_t}=\frac{dy_c}{dz_t}+$$

$$\frac{a_{12}\frac{da_x}{dz_t}+a_x\frac{da_{12}}{dz_t}-a_{11}\frac{da_y}{dz_t}-a_y\frac{da_{11}}{dz_t}}{A}-\frac{a_{12}a_x-a_{11}a_y}{A^2}\frac{dA}{dz_t}$$

where $A=a_{22}a_{11}-a_{12}^2$

The derivatives are then evaluated with the appropriate values of the random variables. Since $a_x$ and $a_y$ are both zero the first derivatives reduce to the following equations:

$$\left.\frac{dx_t}{dz_t}\right|=\frac{dx_c}{dz_t}+\frac{a_{12}\frac{da_y}{dz_t}-a_{22}\frac{da_x}{dz_t}}{A}$$

$$\left.\frac{dy_t}{dz_t}\right|=\frac{dy_c}{dz_t}+\frac{a_{12}\frac{da_x}{dz_t}-a_{11}\frac{da_y}{dz_t}}{A}$$

The derivatives of $a_x$ and $a_y$ with respect to $z_t$ need to be computed. The variables $a_x$ and $a_y$ are a function of all the measured variables as well as $x_t$, $y_t$ and $z_t$. The measured variables are assumed to be independent of each other and therefore do not vary as a function of $z_t$. The chain rule for derivatives is used to calculate the total derivatives of $a_x$ and $a_y$ with respect to $z_t$ as follows:

$$\frac{da_x}{dz_t}=\frac{\partial a_x}{\partial z_t}+\frac{\partial a_x}{\partial x_t}\frac{dx_t}{dz_t}+\frac{\partial a_x}{\partial y_t}\frac{dy_t}{dz_t}=\frac{\partial a_x}{\partial z_t}+a_{11}\frac{dx_t}{dz_t}+a_{12}\frac{dy_t}{dz_t} \quad \text{(Eq 1)}$$

$$\frac{da_y}{dz_t}=\frac{\partial a_y}{\partial z_t}+\frac{\partial a_y}{\partial x_t}\frac{dx_t}{dz_t}+\frac{\partial a_y}{\partial y_t}\frac{dy_t}{dz_t}=\frac{\partial a_y}{\partial z_t}+a_{12}\frac{dx_t}{dz_t}+a_{22}\frac{dy_t}{dz_t} \quad \text{(Eq 2)}$$

When these expressions are substituted into the previous equations some cancellations occur which result in the final equations for the linear terms of the Taylor series expansion.

$$\left.\frac{dx_t}{dz_t}\right| = \frac{a_{12}\frac{\partial a_y}{\partial z_t} - a_{22}\frac{\partial a_x}{\partial z_t}}{A} \quad \text{(Eq 3)}$$

$$\left.\frac{dy_t}{dz_t}\right| = \frac{a_{12}\frac{\partial a_x}{\partial z_t} - a_{11}\frac{\partial a_y}{\partial z_t}}{A} \quad \text{(Eq 4)}$$

The partial derivatives of $a_x$ and $a_y$ with respect to $z_t$ are required to compute the linear terms of the Taylor series expansion.

$$\frac{\partial a_x}{\partial z_t} = \sum_{n=1}^{N} \frac{1}{R_e(n)}\left[\frac{r(n)}{\sigma_1^2(n)} + \frac{V_e(n)v(n)}{\sigma_2^2(n)}\right]\frac{\partial S(n)}{\partial x_t}\frac{\partial S(n)}{\partial z_t} + \frac{v_x(n)v_z(n) + v(n)\left[v_x(n)\frac{\partial S(n)}{\partial z_t} + v_z(n)\frac{\partial S(n)}{\partial x_t}\right]}{\sigma_2^2(n)}$$

$$\frac{\partial a_y}{\partial z_t} = \sum_{n=1}^{N} \frac{1}{R_e(n)}\left[\frac{r(n)}{\sigma_1^2(n)} + \frac{V_e(n)v(n)}{\sigma_2^2(n)}\right]\frac{\partial S(n)}{\partial y_t}\frac{\partial S(n)}{\partial z_t} + \frac{v_y(n)v_z(n) + v(n)\left[v_y(n)\frac{\partial S(n)}{\partial z_t} + v_z(n)\frac{\partial S(n)}{\partial y_t}\right]}{\sigma_2^2(n)}$$

where

-continued $$\frac{\partial S(n)}{\partial z_t} = -\frac{z(n) - z_t}{R_e(n)} \quad \frac{\partial T(n)}{\partial z_t} = -v_z(n) - v(n)\frac{\partial S(n)}{\partial z_t}$$

$$\frac{\partial^2 S(n)}{\partial x_t \partial z_t} = -\frac{1}{R_e(n)}\frac{\partial S(n)}{\partial x_t}\frac{\partial S(n)}{\partial z_t}$$

$$\frac{\partial^2 T(n)}{\partial x_t \partial z_t} = \frac{v(n)}{R_e(n)}\frac{\partial S(n)}{\partial x_t}\frac{\partial S(n)}{\partial z_t}$$

$$\frac{\partial^2 S(n)}{\partial y_t \partial z_t} = -\frac{1}{R_e(n)}\frac{\partial S(n)}{\partial y_t}\frac{\partial S(n)}{\partial z_t}$$

$$\frac{\partial^2 T(n)}{\partial y_t \partial z_t} = \frac{v(n)}{R_e(n)}\frac{\partial S(n)}{\partial y_t}\frac{\partial S(n)}{\partial z_t}$$

The expressions for the derivatives of S(n) are substituted in to arrive at the final form.

$$\frac{\partial a_x}{\partial z_t} = \sum_{n=1}^{N} \frac{[x(n) - x_t][z(n) - z_t]}{R_e(n)^3}\left(\frac{r(n)}{\sigma_1^2(n)} + \frac{V_e(n)v(n)}{\sigma_2^2(n)}\right) + \frac{1}{\sigma_2^2(n)}\left[v_x(n)v_z(n) - v(n)\frac{v_x(n)[z(n) - z_t] + v_z(n)[x(n) - x_t]}{R_e(n)}\right]$$

$$\frac{\partial a_y}{\partial z_t} = \sum_{n=1}^{N} \frac{[y(n) - y_t][z(n) - z_t]}{R_e(n)^3}\left(\frac{r(n)}{\sigma_1^2(n)} + \frac{V_e(n)v(n)}{\sigma_2^2(n)}\right) + \frac{1}{\sigma_2^2(n)}\left[v_y(n)v_z(n) - v(n)\frac{v_y(n)[z(n) - z_t] + v_z(n)[y(n) - y_t]}{R_e(n)}\right]$$

Taylor series expansion in z: Quadratic terms. The quadratic terms of the Taylor series expansion are found by taking the second derivative of $x_t$ and $y_t$ with respect to $z_t$.

$$\frac{d^2x_t}{dz_t^2} = \frac{d^2x_c}{dz_t^2} + \frac{a_{12}\frac{d^2a_y}{dz_t^2} + 2\frac{da_{12}}{dz_t}\frac{da_y}{dz_t} + a_y\frac{d^2a_{12}}{dz_t^2} - a_{22}\frac{d^2a_x}{dz_t^2} - 2\frac{da_{22}}{dz_t}\frac{da_x}{dz_t} - a_x\frac{d^2a_{22}}{dz_t^2}}{A} - 2\frac{a_{12}\frac{da_y}{dz_t} + a_y\frac{da_{12}}{dz_t} - a_{22}\frac{da_x}{dz_t} - a_x\frac{da_{22}}{dz_t}}{A^2}\frac{dA}{dz_t} - \frac{a_{12}a_y - a_{22}a_x}{A^2}\frac{d^2A}{dz_t^2} + 2\frac{a_{12}a_y - a_{22}a_x}{A^3}\left(\frac{dA}{dz_t}\right)^2$$

$$\frac{d^2y_t}{dz_t^2} = \frac{d^2y_c}{dz_t^2} + \frac{a_{12}\frac{d^2a_x}{dz_t^2} + 2\frac{da_{12}}{dz_t}\frac{da_x}{dz_t} + a_x\frac{d^2a_{12}}{dz_t^2} - a_{11}\frac{d^2a_y}{dz_t^2} - 2\frac{da_{11}}{dz_t}\frac{da_y}{dz_t} - a_y\frac{d^2a_{11}}{dz_t^2}}{A} - 2\frac{a_{12}\frac{da_x}{dz_t} + a_y\frac{da_{12}}{dz_t} - a_{11}\frac{da_y}{dz_t} - a_y\frac{da_{11}}{dz_t}}{A^2}\frac{dA}{dz_t} - \frac{a_{12}a_x - a_{11}a_x}{A^2}\frac{d^2A}{dz_t^2} + 2\frac{a_{12}a_x - a_{11}a_y}{A^3}\left(\frac{dA}{dz_t}\right)^2$$

When the appropriate values of the random variables are substituted in the following two expressions can be shown to be equal to zero.

$$a_{12}\frac{da_y}{dz_t} + a_y\frac{da_{12}}{dz_t} - a_{22}\frac{da_x}{dz_t} - a_x\frac{da_{22}}{dz_t} = 0$$

$$a_{12}\frac{da_x}{dz_t} + a_x\frac{da_{12}}{dz_t} - a_{11}\frac{da_y}{dz_t} - a_y\frac{da_{11}}{dz_t} = 0$$

Using this fact and the fact that $a_x$ and $a_y$ are both equal to zero the second derivatives simplify to the following equations:

$$\left.\frac{d^2x_t}{dz_t^2}\right| = \frac{d^2x_c}{dz_t^2} + \frac{a_{12}\frac{d^2a_y}{dz_t^2} + 2\frac{da_{12}}{dz_t}\frac{da_y}{dz_t} - a_{22}\frac{d^2a_x}{dz_t^2} - 2\frac{da_{22}}{dz_t}\frac{da_x}{dz_t}}{A}$$

$$\left.\frac{d^2y_t}{dz_t^2}\right| = \frac{d^2y_c}{dz_t^2} + \frac{a_{12}\frac{d^2a_x}{dz_t^2} + 2\frac{da_{12}}{dz_t}\frac{da_x}{dz_t} - a_{11}\frac{d^2a_y}{dz_t^2} - 2\frac{da_{11}}{dz_t}\frac{da_y}{dz_t}}{A}$$

The second derivatives of $a_x$ and $a_y$ with respect to $z_t$ are calculated using the chain rule for derivatives.

$$\frac{d^2a_x}{dz_t^2} = \frac{\partial^2a_x}{\partial z_t^2} + \frac{\partial a_{11}}{\partial z_t}\frac{dx_t}{dz_t} + \frac{\partial a_{12}}{\partial z_t}\frac{dy_t}{dz_t} + a_{11}\frac{d^2x_t}{dz_t^2} + \frac{da_{11}}{dz_t}\frac{dx_t}{dz_t} + a_{12}\frac{d^2y_t}{dz_t^2} + \frac{da_{12}}{dz_t}\frac{dy_t}{dz_t} \quad \text{(Eq 5)}$$

$$\frac{d^2a_y}{dz_t^2} = \frac{\partial^2a_y}{\partial z_t^2} + \frac{\partial a_{12}}{\partial z_t}\frac{dx_t}{dz_t} + \frac{\partial a_{22}}{\partial z_t}\frac{dy_t}{dz_t} + a_{12}\frac{d^2x_t}{dz_t^2} + \frac{da_{12}}{dz_t}\frac{dx_t}{dz_t} + a_{22}\frac{d^2y_t}{dz_t^2} + \frac{da_{22}}{dz_t}\frac{dy_t}{dz_t} \quad \text{(Eq 6)}$$

When these expressions are substituted into the previous equations some cancellations occur which result in the final equations for the quadratic terms of the Taylor series expansion.

$$\left.\frac{d^2x_t}{dz_t^2}\right| = \frac{Ca_{12} + 2\frac{da_{12}}{dz_t}\frac{da_y}{dz_t} - Ba_{22} - 2\frac{da_{22}}{dz_t}\frac{da_x}{dz_t}}{A} \quad \text{(Eq 7)}$$

$$\left.\frac{d^2y_t}{dz_t^2}\right| = \frac{Ba_{12} + 2\frac{da_{12}}{dz_t}\frac{da_x}{dz_t} - Ca_{11} - 2\frac{da_{11}}{dz_t}\cdot\frac{da_y}{dz_t}}{A} \quad \text{(Eq 8)}$$

where $$B = \frac{\partial^2a_x}{\partial z_t^2} + \frac{\partial a_{11}}{\partial z_t}\frac{dx_t}{dz_t} + \frac{\partial a_{12}}{\partial z_t}\frac{dy_t}{dz_t} + \frac{da_{11}}{dz_t}\frac{dx_t}{dz_t} + \frac{da_{12}}{dz_t}\frac{dy_t}{dz_t}$$

-continued $$C = \frac{\partial^2a_y}{\partial z_t^2} + \frac{\partial a_{12}}{\partial z_t}\frac{dx_t}{dz_t} + \frac{\partial a_{22}}{\partial z_t}\frac{dy_t}{dz_t} + \frac{da_{12}}{dz_t}\frac{dx_t}{dz_t} + \frac{da_{22}}{dz_t}\frac{dy_t}{dz_t}$$

The first derivatives of $a_x$ and $a_y$ with respect to $z_t$ are computed using equations 1 and 2 respectively. The first derivatives of $a_{11}$, $a_{22}$ and $a_{12}$ with respect to $z_t$ are calculated using the chain rule for derivatives.

$$\frac{da_{11}}{dz_t} = \frac{\partial a_{11}}{\partial z_t} + \frac{\partial a_{11}}{\partial x_t}\frac{dx_t}{dz_t} + \frac{\partial a_{11}}{\partial y_t}\frac{dy_t}{dz_t} \quad \text{(Eq 9)}$$

$$\frac{da_{22}}{dz_t} = \frac{\partial a_{22}}{\partial z_t} + \frac{\partial a_{22}}{\partial x_t}\frac{dx_t}{dz_t} + \frac{\partial a_{22}}{\partial y_t}\frac{dy_t}{dz_t} \quad \text{(Eq 10)}$$

$$\frac{da_{12}}{dz_t} = \frac{\partial a_{12}}{\partial z_t} + \frac{\partial a_{12}}{\partial x_t}\frac{dx_t}{dz_t} + \frac{\partial a_{12}}{\partial y_t}\frac{dy_t}{dz_t} \quad \text{(Eq 11)}$$

The following partial derivatives are required to complete the computation of the quadratic terms of the Taylor series expansion.

$$\frac{\partial^2a_x}{\partial z_t^2} = \sum_{n=1}^{N}\frac{1}{R_e(n)}\left(\frac{1}{R_e(n)}\frac{\partial S(n)}{\partial x_t}\left[\frac{r(n)}{\sigma_1^2(n)} + \frac{V_e(n)v(n)}{\sigma_2^2(n)}\right] + \frac{v(n)v_x(n)}{\sigma_2^2(n)}\right) + \left(1 - 3\left(\frac{\partial S(n)}{\partial z_t}\right)^2\right) + \frac{2v(n)}{\sigma_2^2(n)R_e(n)}\frac{\partial S(n)}{\partial z_t}\left(v_x(n)\frac{\partial S(n)}{\partial z_t} - v_z(n)\frac{\partial S(n)}{\partial x_t}\right)$$

$$\frac{\partial^2a_y}{\partial z_t^2} = \sum_{n=1}^{N}\frac{1}{R_e(n)}\left(\frac{1}{R_e(n)}\frac{\partial S(n)}{\partial y_t}\left[\frac{r(n)}{\sigma_1^2(n)} + \frac{V_e(n)v(n)}{\sigma_2^2(n)}\right] + \frac{v(n)v_y(n)}{\sigma_2^2(n)}\right) + \left(1 - 3\left(\frac{\partial S(n)}{\partial z_t}\right)^2\right) + \frac{2v(n)}{\sigma_2^2(n)R_e(n)}\frac{\partial S(n)}{\partial z_t}\left(v_y(n)\frac{\partial S(n)}{\partial z_t} - v_z(n)\frac{\partial S(n)}{\partial y_t}\right)$$

$$\frac{\partial a_{11}}{\partial x_t} = \sum_{n=1}^{N}\frac{3}{R_e(n)}\left(\frac{1}{R_e(n)}\frac{\partial S(n)}{\partial x_t}\left[\frac{r(n)}{\sigma_1^2(n)} + \frac{V_e(n)v(n)}{\sigma_2^2(n)}\right] + \frac{v(n)v_x(n)}{\sigma_2^2(n)}\right)\left(1 - \left(\frac{\partial S(n)}{\partial x_t}\right)^2\right)$$

$$\frac{\partial^2a_{22}}{\partial x_t} = \sum_{n=1}^{N}\frac{1}{R_e(n)}\left(\frac{1}{R_e(n)}\frac{\partial S(n)}{\partial x_t}\left[\frac{r(n)}{\sigma_1^2(n)} + \frac{V_e(n)v(n)}{\sigma_2^2(n)}\right] + \frac{v(n)v_x(n)}{\sigma_2^2(n)}\right) + \left(1 - 3\left(\frac{\partial S(n)}{\partial y_t}\right)^2\right) + \frac{2v(n)}{\sigma_2^2(n)R_e(n)}\frac{\partial S(n)}{\partial y_t}\left(v_x(n)\frac{\partial S(n)}{\partial y_t} - v_y(n)\frac{\partial S(n)}{\partial x_t}\right)$$

$$\frac{\partial^2a_{12}}{\partial x_t} = \sum_{n=1}^{N}\frac{1}{R_e(n)}\left(\frac{1}{R_e(n)}\frac{\partial S(n)}{\partial y_t}\left[\frac{r(n)}{\sigma_1^2(n)} + \right.\right.$$

-continued $$\frac{V_e(n)v(n)}{\sigma_2^2(n)}\Bigg]+\frac{v(n)v_y(n)}{\sigma_2^2(n)}\Bigg)+\left(1-3\left(\frac{\partial S(n)}{\partial x_t}\right)^2\right)+$$

$$\frac{2v(n)}{\sigma_2^2(n)R_e(n)}\ \frac{\partial S(n)}{\partial x_t}\left(v_y(n)\frac{\partial S(n)}{\partial x_t}-v_x(n)\frac{\partial S(n)}{\partial y_t}\right)$$

$$\frac{\partial^2 a_{11}}{\partial y_t}=\sum_{n=1}^{N}\frac{1}{R_e(n)}\left(\frac{1}{R_e(n)}\ \frac{\partial S(n)}{\partial y_t}\left[\frac{r(n)}{\sigma_1^2(n)}+\right.\right.$$

$$\frac{V_e(n)v(n)}{\sigma_2^2(n)}\Bigg]+\frac{v(n)v_y(n)}{\sigma_2^2(n)}\Bigg)+\left(1-3\left(\frac{\partial S(n)}{\partial x_t}\right)^2\right)+$$

$$\frac{2v(n)}{\sigma_2^2(n)R_e(n)}\ \frac{\partial S(n)}{\partial x_t}\left(v_y(n)\frac{\partial S(n)}{\partial x_t}-v_x(n)\frac{\partial S(n)}{\partial y_t}\right)$$

$$\frac{\partial a_{22}}{\partial y_t}=\sum_{n=1}^{N}\frac{3}{R_e(n)}\left(\frac{1}{R_e(n)}\ \frac{\partial S(n)}{\partial y_t}\left[\frac{r(n)}{\sigma_1^2(n)}+\right.\right.$$

$$\left.\left.\frac{V_e(n)v(n)}{\sigma_2^2(n)}\Bigg]+\frac{v(n)v_y(n)}{\sigma_2^2(n)}\right)\left(1-\left(\frac{\partial S(n)}{\partial y_t}\right)^2\right)\right)$$

$$\frac{\partial^2 a_{12}}{\partial y_t}=\sum_{n=1}^{N}\frac{1}{R_e(n)}\left(\frac{1}{R_e(n)}\ \frac{\partial S(n)}{\partial x_t}\left[\frac{r(n)}{\sigma_1^2(n)}+\right.\right.$$

$$\frac{V_e(n)v(n)}{\sigma_2^2(n)}\Bigg]+\frac{v(n)v_x(n)}{\sigma_2^2(n)}\Bigg)+\left(1-3\left(\frac{\partial S(n)}{\partial y_t}\right)^2\right)+$$

$$\frac{2v(n)}{\sigma_2^2(n)R_e(n)}\ \frac{\partial S(n)}{\partial y_t}\left(v_x(n)\frac{\partial S(n)}{\partial y_t}-v_y(n)\frac{\partial S(n)}{\partial x_t}\right)$$

$$\frac{\partial^2 a_{11}}{\partial z_t}=\sum_{n=1}^{N}\frac{1}{R_e(n)}\left(\frac{1}{R_e(n)}\ \frac{\partial S(n)}{\partial z_t}\left[\frac{r(n)}{\sigma_1^2(n)}+\right.\right.$$

-continued $$\frac{V_e(n)v(n)}{\sigma_2^2(n)}\Bigg]+\frac{v(n)v_z(n)}{\sigma_2^2(n)}\Bigg)+\left(1-3\left(\frac{\partial S(n)}{\partial x_t}\right)^2\right)+$$

$$\frac{2v(n)}{\sigma_2^2(n)R_e(n)}\ \frac{\partial S(n)}{\partial x_t}\left(v_z(n)\frac{\partial S(n)}{\partial x_t}-v_x(n)\frac{\partial S(n)}{\partial z_t}\right)$$

$$\frac{\partial^2 a_{22}}{\partial z_t}=\sum_{n=1}^{N}\frac{1}{R_e(n)}\left(\frac{1}{R_e(n)}\ \frac{\partial S(n)}{\partial z_t}\left[\frac{r(n)}{\sigma_1^2(n)}+\right.\right.$$

$$\frac{V_e(n)v(n)}{\sigma_2^2(n)}\Bigg]+\frac{v(n)v_z(n)}{\sigma_2^2(n)}\Bigg)+\left(1-3\left(\frac{\partial S(n)}{\partial y_t}\right)^2\right)+$$

$$\frac{2v(n)}{\sigma_2^2(n)R_e(n)}\ \frac{\partial S(n)}{\partial y_t}\left(v_z(n)\frac{\partial S(n)}{\partial y_t}-v_y(n)\frac{\partial S(n)}{\partial z_t}\right)$$

$$\frac{\partial a_{12}}{\partial z_t}=\sum_{n=1}^{N}\frac{-3}{R_e(n)^2}\left[\frac{r(n)}{\sigma_1^2(n)}+\right.$$

$$\left.\frac{V_e(n)\ v(n)}{\sigma_2^2(n)}\right]\frac{\partial S(n)}{\partial x_t}\ \frac{\partial S(n)}{\partial y_t}\ \frac{\partial S(n)}{\partial z_t}-$$

$$\frac{v(n)}{\sigma_2^2(n)R_e(n)}\left[v_x(n)\frac{\partial S(n)}{\partial y_t}\ \frac{\partial S(n)}{\partial z_t}+\right.$$

$$\left.v_y(n)\frac{\partial S(n)}{\partial x_t}\ \frac{\partial S(n)}{\partial z_t}+v_z(n)\frac{\partial S(n)}{\partial x_t}\ \frac{\partial S(n)}{\partial y_t}\right]$$

where $$\frac{\partial^2 S(n)}{\partial z_t^2}=\frac{1}{R_e(n)}\left(1-\left(\frac{\partial S(n)}{\partial z_t}\right)^2\right)$$

$$\frac{\partial^2 T(n)}{\partial z_t^2}=-\frac{v(n)}{R_e(n)}\left(1-\left(\frac{\partial S(n)}{\partial z_t}\right)^2\right)$$

The expressions for the derivatives of S(n) are substituted in to arrive at the final form.

$$\frac{\partial^2 a_x}{\partial z_t^2}=\sum_{n=1}^{N}\frac{1}{R_e(n)}\left(\frac{x(n)-x_t}{R_e(n)^2}\left[\frac{r(n)}{\sigma_1^2(n)}+\frac{V_e(n)v(n)}{\sigma_2^2(n)}\right]-\frac{v(n)v_x(n)}{\sigma_2^2(n)}\right)\left(3\frac{[z(n)-z_t]^2}{R_e(n)^2}-1\right)+$$

$$\frac{2\ v(n)[x(n)-x_t]\ [z(n)-z_t]^2}{\sigma_2^2(n)R_e(n)^2}\left(\frac{v_x(n)}{x(n)-x_t}-\frac{v_z(n)}{z(n)-z_t}\right)$$

$$\frac{\partial^2 a_y}{\partial z_1^2}=\sum_{n=1}^{N}\frac{1}{R_e(n)}\left(\frac{y(n)-y_t}{R_e(n)^2}\left[\frac{r(n)}{\sigma_1^2(n)}+\frac{V_e(n)v(n)}{\sigma_2^2(n)}\right]-\frac{v(n)v_y(n)}{\sigma_2^2(n)}\right)\left(3\frac{[z(n)-z_t]^2}{R_e(n)^2}-1\right)+$$

$$\frac{2\ v(n)[y(n)-y_t]\ [z(n)-z_t]^2}{\sigma_2^2(n)R_e(n)^2}\left(\frac{v_y(n)}{y(n)-y_t}-\frac{v_z(n)}{z(n)-z_t}\right)$$

$$\frac{\partial a_{11}}{\partial x_t}=\sum_{n=1}^{N}\frac{3}{R_e(n)}\left(\frac{x(n)-x_t}{R_e(n)^2}\left[\frac{r(n)}{\sigma_1^2(n)}+\frac{V_e(n)v(n)}{\sigma_2^2(n)}\right]-\frac{v(n)v_x(n)}{\sigma_2^2(n)}\right)\left(\frac{[x(n)-x_t]^2}{R_e(n)^2}-1\right)$$

$$\frac{\partial a_{22}}{\partial x_t}=\sum_{n=1}^{N}\frac{1}{R_e(n)}\left(\frac{x(n)-x_t}{R_e(n)^2}\left[\frac{r(n)}{\sigma_1^2(n)}+\frac{V_e(n)v(n)}{\sigma_2^2(n)}\right]-\frac{v(n)v_x(n)}{\sigma_2^2(n)}\right)\left(3\frac{[y(n)-y_t]^2}{R_e(n)^2}-1\right)+$$

-continued $$\frac{2\,v(n)[x(n)-x_t]\,[y(n)-y_t]^2}{\sigma_2^2(n)R_e(n)^2}\left(\frac{v_x(n)}{x(n)-x_t}-\frac{v_y(n)}{y(n)-y_t}\right)$$

$$\frac{\partial a_{12}}{\partial x_t}=\sum_{n=1}^{N}\frac{1}{R_e(n)}\left(\frac{y(n)-y_t}{R_e(n)^2}\left[\frac{r(n)}{\sigma_1^2(n)}+\frac{V_e(n)v(n)}{\sigma_2^2(n)}\right]-\frac{v(n)v_y(n)}{\sigma_2^2(n)}\right)\left(3\frac{[x(n)-x_t]^2}{R_e(n)^2}-1\right)+$$

$$\frac{2\,v(n)\,[x(n)-x_t]^2\,[y(n)-y_t]}{\sigma_2^2(n)R_e(n)^2}\left(\frac{v_y(n)}{y(n)-y_t}-\frac{v_x(n)}{x(n)-x_t}\right)$$

$$\frac{\partial a_{11}}{\partial y_t}=\sum_{n=1}^{N}\frac{1}{R_e(n)}\left(\frac{y(n)-y_t}{R_e(n)^2}\left[\frac{r(n)}{\sigma_1^2(n)}+\frac{V_e(n)v(n)}{\sigma_2^2(n)}\right]-\frac{v(n)v_y(n)}{\sigma_2^2(n)}\right)\left(3\frac{[x(n)-x_t]^2}{R_e(n)^2}-1\right)+$$

$$\frac{2\,v(n)\,[x(n)-x_t]^2\,[y(n)-y_t]}{\sigma_2^2(n)R_e(n)^2}\left(\frac{v_y(n)}{y(n)-y_t}-\frac{v_x(n)}{x(n)-x_t}\right)$$

$$\frac{\partial a_{22}}{\partial y_t}=\sum_{n=1}^{N}\frac{3}{R_e(n)}\left(\frac{y(n)-y_t}{R_e(n)^2}\left[\frac{r(n)}{\sigma_1^2(n)}+\frac{V_e(n)v(n)}{\sigma_2^2(n)}\right]-\frac{v(n)v_y(n)}{\sigma_2^2(n)}\right)\left(\frac{[y(n)-y_t]^2}{R_e(n)^2}-1\right)$$

$$\frac{\partial a_{12}}{\partial y_t}=\sum_{n=1}^{N}\frac{1}{R_e(n)}\left(\frac{x(n)-x_t}{R_e(n)^2}\left[\frac{r(n)}{\sigma_1^2(n)}+\frac{V_e(n)v(n)}{\sigma_2^2(n)}\right]-\frac{v(n)v_x(n)}{\sigma_2^2(n)}\right)\left(3\frac{[y(n)-y_t]^2}{R_e(n)^2}-1\right)+$$

$$\frac{2\,v(n)[x(n)-x_t]\,[y(n)-y_t]^2}{\sigma_2^2(n)R_e(n)^2}\left(\frac{v_x(n)}{x(n)-x_t}-\frac{v_y(n)}{y(n)-y_t}\right)$$

$$\frac{\partial a_{11}}{\partial z_t}=\sum_{n=1}^{N}\frac{1}{R_e(n)}\left(\frac{z(n)-z_t}{R_e(n)^2}\left[\frac{r(n)}{\sigma_1^2(n)}+\frac{V_e(n)v(n)}{\sigma_2^2(n)}\right]-\frac{v(n)v_z(n)}{\sigma_2^2(n)}\right)\left(3\frac{[x(n)-x_t]^2}{R_e(n)^2}-1\right)+$$

$$\frac{2\,v(n)\,[x(n)-x_t]^2\,[z(n)-z_t]}{\sigma_2^2(n)R_e(n)^2}\left(\frac{v_z(n)}{z(n)-z_t}-\frac{v_x(n)}{x(n)-x_t}\right)$$

$$\frac{\partial a_{22}}{\partial z_t}=\sum_{n=1}^{N}\frac{1}{R_e(n)}\left(\frac{z(n)-z_t}{R_e(n)^2}\left[\frac{r(n)}{\sigma_1^2(n)}+\frac{V_e(n)v(n)}{\sigma_2^2(n)}\right]-\frac{v(n)v_z(n)}{\sigma_2^2(n)}\right)\left(3\frac{[y(n)-y_t]^2}{R_e(n)^2}-1\right)+$$

$$\frac{2\,v(n)\,[y(n)-y_t]^2\,[z(n)-z_t]}{\sigma_2^2(n)R_e(n)^2}\left(\frac{v_z(n)}{z(n)-z_t}-\frac{v_y(n)}{y(n)-y_t}\right)$$

$$\frac{\partial a_{12}}{\partial z_t}=\sum_{n=1}^{N}\frac{3[x(n)-x_t][y(n)-y_t][z(n)-z_t]}{R_e(n)^5}\left[\frac{r(n)}{\sigma_1^2(n)}+\frac{V_e(n)v(n)}{\sigma_2^2(n)}\right]-$$

$$\frac{v(n)[x(n)-x_t][y(n)-y_t][z(n)-z_t]}{\sigma_2^2(n)R_e(n)^3}\left[\frac{v_x(n)}{x(n)-x_t}+\frac{v_y(n)}{y(n)-y_t}+\frac{v_z(n)}{z(n)-z_t}\right]$$

Taylor series expansion in z: Cubic terms. The cubic terms of the Taylor series expansion are found by taking the third derivative of $x_t$ and $y_t$ with respect to $z_t$.

$$\frac{d^3x_t}{dz_t^3}=\frac{d^3x_c}{dz_t^3}+\frac{a_{12}\frac{d^3a_y}{dz_t^3}+3\frac{da_{12}}{dz_t}\frac{d^2a_y}{dz_t^2}+3\frac{d^2a_{12}}{dz_t^2}\frac{da_y}{dz_t}+a_y\frac{d^3a_{12}}{dz_t^3}}{A}-$$

$$\frac{a_{22}\frac{d^3a_x}{dz_t^3}+3\frac{d^2a_x}{dz_t^2}\frac{da_{22}}{dz_t}+3\frac{da_x}{dz_t}\frac{d^2a_{22}}{dz_t^2}+a_x\frac{d^3a_{22}}{dz_t^3}}{A}-$$

$$3\frac{a_{12}\frac{d^2a_y}{dz_t^2}+2\frac{da_{12}}{dz_t}\frac{da_y}{dz_t}+a_y\frac{d^2a_{12}}{dz_t^2}-a_{22}\frac{d^2a_x}{dz_t^2}-2\frac{da_x}{dz_t}\frac{da_{22}}{dz_t}-a_x\frac{d^2a_{22}}{dz_t^2}}{A^2}\frac{dA}{dz_t}-$$

-continued $$3\frac{a_{12}\frac{da_y}{dz_t}+a_y\frac{da_{12}}{dz_t}-a_{22}\frac{da_x}{dz_t}-a_x\frac{da_{22}}{dz_t}}{A^2}\frac{d^2A}{dz_t^2}+$$

$$6\frac{a_{12}\frac{da_y}{dz_t}+a_y\frac{da_{12}}{dz_t}-a_{22}\frac{da_x}{dz_t}-a_x\frac{da_{22}}{dz_t}}{A^3}\left(\frac{dA}{dz_t}\right)^2-$$

$$\frac{a_{12}a_y-a_{22}a_x}{A^2}\frac{d^3A}{dz_t^3}+6\frac{a_{12}a_y-a_{22}a_x}{A^3}\frac{d^2A}{dz_t^2}\frac{dA}{dz_t}-6\frac{a_{12}a_y-a_{22}a_x}{A^4}\left(\frac{dA}{dz_t}\right)^3$$

$$\frac{d^3y_t}{dz_t^3}=\frac{d^3y_c}{dz_t^3}+\frac{a_{12}\frac{d^3a_x}{dz_t^3}+3\frac{da_{12}}{dz_t}\frac{d^2a_x}{dz_t^2}+3\frac{d^2a_{12}}{dz_t^2}\frac{da_x}{dz_t}+a_x\frac{d^3a_{12}}{dz_t^3}}{A}-$$

$$\frac{a_{11}\frac{d^3a_y}{dz_t^3}+3\frac{d^2a_y}{dz_t^2}\frac{da_{11}}{dz_t}+3\frac{da_y}{dz_t}\frac{d^2a_{11}}{dz_t^2}+a_y\frac{d^3a_{11}}{dz_t^3}}{A}-$$

$$3\frac{a_{12}\frac{d^2a_x}{dz_t^2}+2\frac{da_{12}}{dz_t}\frac{da_x}{dz_t}+a_x\frac{d^2a_{12}}{dz_t^2}-a_{11}\frac{d^2a_y}{dz_t^2}-2\frac{da_y}{dz_t}\frac{da_{11}}{dz_t}-a_y\frac{d^2a_{11}}{dz_t^2}}{A^2}\frac{dA}{dz_t}-$$

$$3\frac{a_{12}\frac{da_x}{dz_t}+a_x\frac{da_{12}}{dz_t}-a_{11}\frac{da_y}{dz_t}-a_y\frac{da_{11}}{dz_t}}{A^2}\frac{d^2A}{dz_t^2}+$$

$$6\frac{a_{12}\frac{da_x}{dz_t}+a_x\frac{da_{12}}{dz_t}-a_{11}\frac{da_y}{dz_t}-a_y\frac{da_{11}}{dz_t}}{A^3}\left(\frac{dA}{dz_t}\right)^2-$$

$$\frac{a_{12}a_x-a_{11}a_y}{A^2}\frac{d^3A}{dz_t^3}+6\frac{a_{12}a_x-a_{11}a_y}{A^3}\frac{d^2A}{dz_t^2}\frac{dA}{dz_t}-6\frac{a_{12}a_x-a_{11}a_y}{A^4}\left(\frac{dA}{dz_t}\right)^3$$

When the appropriate values of the random variables are substituted in the following two expressions can be shown to be equal to zero.

$$a_{12}\frac{d^2a_y}{dz_t^2}+2\frac{da_{12}}{dz_t}\frac{da_y}{dz_t}+a_y\frac{d^2a_{12}}{dz_t^2}-a_{22}\frac{d^2a_x}{dz_t^2}-$$

$$2\frac{da_x}{dz_t}\frac{da_{22}}{dz_t}-a_x\frac{d^2a_{22}}{dz_t^2}=0$$

$$a_{12}\frac{d^2a_x}{dz_t^2}+2\frac{da_{12}}{dz_t}\frac{da_x}{dz_t}+a_x\frac{d^2a_{12}}{dz_t^2}-a_{11}\frac{d^2a_y}{dz_t^2}-$$

-continued $$2\frac{da_y}{dz_t}\frac{da_{11}}{dz_t}-a_y\frac{d^2a_{11}}{dz_t^2}=0$$

Using this fact and the fact that $a_x$ and $a_y$ are both equal to zero the third derivatives simplify to the following equations:

$$\left.\frac{d^3x_t}{dz_t^3}\right|=\frac{d^3x_c}{dz_t^3}+$$

$$\frac{a_{12}\frac{d^3a_y}{dz_t^3}+3\frac{da_{12}}{dz_t}\frac{d^2a_y}{dz_t^2}+3\frac{d^2a_{12}}{dz_t^2}\frac{da_y}{dz_t}-a_{22}\frac{d^3a_x}{dz_t^3}-3\frac{d^2a_x}{dz_t^2}\frac{da_{22}}{dz_t}-3\frac{da_x}{dz_t}\frac{d^2a_{22}}{dz_t^2}}{A}$$

$$\left.\frac{d^3y_t}{dz_t^3}\right|=\frac{d^3y_c}{dz_t^3}+$$

$$\frac{a_{12}\frac{d^3a_x}{dz_t^3}+3\frac{da_{12}}{dz_t}\frac{d^2a_x}{dz_t^2}+3\frac{d^2a_{12}}{dz_t^2}\frac{da_x}{dz_t}-a_{11}\frac{d^2a_y}{dz_t^3}-3\frac{d^2a_y}{dz_t^2}\frac{da_{11}}{dz_t}-3\frac{da_y}{dz_t}\frac{d^2a_{11}}{dz_t^2}}{A}$$

The third derivatives of $a_x$ and $a_y$ with respect to $z_t$ are calculated using the chain rule for derivatives.

$$\frac{d^3a_x}{dz_t^3}=\frac{\partial^3a_x}{\partial z_t^3}+2\frac{\partial^2a_{11}}{\partial z_t^2}\frac{dx_t}{dz_t}+$$

-continued $$2\frac{\partial^2 a_{12}}{\partial z_t^2}\frac{dy_t}{dz_t}+\frac{\partial a_{11}}{\partial z_t}\frac{d^2x_t}{dz_t^2}+\frac{\partial^2 a_{11}}{\partial z_t\partial x_t}\left(\frac{dx_t}{dz_t}\right)^2+$$

$$\frac{\partial^2 a_{11}}{\partial z_t\partial y_t}\frac{dx_t}{dz_t}\frac{dy_t}{dz_t}+\frac{\partial a_{12}d^2y_t}{dz_t^2}+\frac{\partial a_{12}}{\partial z_t\partial x_t}\frac{dx_t}{dz_t}\frac{dy_t}{dz_t}+$$

$$\frac{\partial^2 a_{12}}{\partial z_t\partial y_t}\left(\frac{dy_t}{dz_t}\right)^2+a_{11}\frac{d^3x_t}{dz_t^3}+2\frac{da_{11}}{dz_t}\frac{d^2x_t}{dz_t^2}+$$

$$\frac{d^2a_{11}}{dz_t^2}\frac{dx_t}{dz_t}+a_{12}\frac{d^3y_t}{dz_t^3}+2\frac{da_{12}}{dz_t}\frac{d^2y_t}{dz_t^2}+\frac{d^2a_{12}}{dz_t^2}\frac{dy_t}{dz_t}$$

$$\frac{d^3a_y}{dz_t^3}=\frac{\partial^3 a_y}{\partial z_t^3}+2\frac{\partial^2 a_{12}}{\partial z_t^2}\frac{dx_t}{dz_t}+2\frac{\partial^2 a_{22}}{\partial z_t^2}\frac{dy_t}{dz_t}+$$

$$\frac{\partial a_{12}}{\partial z_t}\frac{d^2x_t}{dz_t^2}+\frac{\partial^2 a_{12}}{\partial z_t\partial x_t}\left(\frac{dx_t}{dz_t}\right)^2+\frac{\partial^2 a_{12}}{\partial z_t\partial y_t}\frac{dx_t}{dz_t}\frac{dy_t}{dz_t}+$$

$$\frac{\partial a_{22}}{\partial z_t}\frac{d^2y_t}{dz_t^2}+\frac{\partial^2 a_{22}}{\partial z_t\partial x_t}\frac{dx_t}{dz_t}\frac{dy_t}{dz_t}+\frac{\partial^2 a_{22}}{\partial z_t\partial y_t}\left(\frac{dy_t}{dz_t}\right)^2+$$

$$a_{12}\frac{d^3x_t}{dz_t^3}+2\frac{da_{12}}{dz_t}\frac{d^2x_t}{dz_t^2}+\frac{d^2a_{12}}{dz_t^2}\frac{dx_t}{dz_t}+a_{22}\frac{d^3y_t}{dz_t^3}+$$

$$2\frac{da_{22}}{dz_t}\frac{d^2y_t}{dz_t^2}+\frac{d^2a_{22}}{dz_t^2}\frac{dy_t}{dz_t}$$

When these expressions are substituted into the previous equations some cancellations occur which result in the final equations for the cubic terms of the Taylor series expansion.

The second derivatives of $a_x$ and $a_y$ with respect to $z_t$ are computed using equations 5 and 6 respectively. The first derivatives of $a_{11}$, $a_{22}$ and $a_{12}$ with respect to $z_t$ are computed using equations 9, 10 and 11 respectively. The second derivatives of $a_{11}$, $a_{22}$ and $a_{12}$ with respect to $z_t$ are calculated using the chain rule for derivatives.

$$\frac{d^2a_{11}}{dz_t^2}=\frac{\partial^2 a_{11}}{\partial z_t^2}+2\frac{\partial^2 a_{11}}{\partial z_t\partial x_t}\frac{dx_t}{dz_t}+2\frac{\partial^2 a_{11}}{\partial z_t\partial y_t}\frac{dy_t}{dz_t}+$$

$$\frac{\partial a_{11}}{\partial x_t}\frac{d^2x_t}{dz_t^2}+\frac{\partial^2 a_{11}}{\partial x_t^2}\left(\frac{dx_t}{dz_t}\right)^2+$$

$$2\frac{\partial^2 a_{11}}{\partial x_t\partial y_t}\frac{dx_t}{dz_t}\frac{dy_t}{dz_t}+\frac{\partial a_{11}}{\partial y_t}\frac{d^2y_t}{dz_t^2}+\frac{\partial^2 a_{11}}{\partial y_t^2}\left(\frac{dy_t}{dz_t}\right)^2$$

$$\frac{d^2a_{22}}{dz_t^2}=\frac{\partial^2 a_{22}}{\partial z_t^2}+2\frac{\partial^2 a_{22}}{\partial z_t\partial x_t}\frac{dx_t}{dz_t}+2\frac{\partial^2 a_{22}}{\partial z_t\partial y_t}\frac{dy_t}{dz_t}+$$

$$\frac{\partial a_{22}}{\partial x_t}\frac{d^2x_t}{dz_t^2}+\frac{\partial^2 a_{22}}{\partial x_t^2}\left(\frac{dx_t}{dz_t}\right)^2+$$

$$2\frac{\partial^2 a_{22}}{\partial x_t\partial y_t}\frac{dx_t}{dz_t}\frac{dy_t}{dz_t}+\frac{\partial a_{22}}{\partial y_t}\frac{d^2y_t}{dz_t^2}+\frac{\partial^2 a_{22}}{\partial y_t^2}\left(\frac{dy_t}{dz_t}\right)^2$$

$$\frac{d^2a_{12}}{dz_t^2}=\frac{\partial^2 a_{12}}{\partial z_t^2}+2\frac{\partial^2 a_{12}}{\partial z_t\partial x_t}\frac{dx_t}{dz_t}+2\frac{\partial^2 a_{12}}{\partial z_t\partial y_t}\frac{dy_t}{dz_t}+$$

$$\frac{\partial a_{12}}{\partial x_t}\frac{d^2x_t}{dz_t^2}+\frac{\partial^2 a_{12}}{\partial x_t^2}\left(\frac{dx_t}{dz_t}\right)^2+$$

$$\left.\frac{d^3x_t}{dz_t^3}\right|=\frac{Ea_{12}+3\frac{da_{12}}{dz_t}\frac{d^2a_y}{dz_t^2}+3\frac{d^2a_{12}}{dz_t^2}\frac{da_y}{dz_t}-Da_{22}-3\frac{d^2a_x}{dz_t^2}\frac{da_{22}}{dz_t}-3\frac{da_x}{dz_t}\frac{d^2a_{22}}{dz_t^2}}{A} \quad \text{(Eq 12)}$$

$$\left.\frac{d^3y_t}{dz_t^3}\right|=\frac{Da_{12}+3\frac{da_{12}}{dz_t}\frac{d^2a_x}{dz_t^2}+3\frac{d^2a_{12}}{dz_t^2}\frac{da_x}{dz_t}-Ea_{11}-3\frac{d^2a_y}{dz_t^2}\frac{da_{11}}{dz_t}-3\frac{da_y}{dz_t}\frac{d^2a_{11}}{dz_t^2}}{A} \quad \text{(Eq 13)}$$

where $$D=\frac{\partial^3 a_x}{\partial z_t^3}+2\frac{\partial^2 a_{11}}{\partial z_t^2}\frac{dx_t}{dz_t}+2\frac{\partial^2 a_{12}}{\partial z_t^2}\frac{dy_t}{dz_t}+\frac{\partial a_{11}}{\partial z_t}\frac{d^2x_t}{dz_t^2}+\frac{\partial^2 a_{11}}{\partial z_t\partial x_t}\left(\frac{dx_t}{dz_t}\right)^2+$$

$$\frac{\partial^2 a_{11}}{\partial z_t\partial y_t}\frac{dx_t}{dz_t}\frac{dy_t}{dz_t}+\frac{\partial a_{12}}{\partial z_t}\frac{d^2y_t}{dz_t^2}+\frac{\partial^2 a_{12}}{\partial z_t\partial x_t}\frac{dx_t}{dz_t}\frac{dy_t}{dz_t}+$$

$$\frac{\partial^2 a_{12}}{\partial z_t\partial y_t}\left(\frac{dy_t}{dz_t}\right)^2+2\frac{da_{11}}{dz_t}\frac{d^2x_t}{dz_t^2}+\frac{d^2a_{11}}{dz_t^2}\frac{dx_t}{dz_t}+2\frac{da_{12}}{dz_t}\frac{d^2y_t}{dz_t^2}+\frac{d^2a_{12}}{dz_t^2}\frac{dy_t}{dz_t}$$

$$E=\frac{\partial^3 a_y}{\partial z_t^3}+2\frac{\partial^2 a_{12}}{\partial z_t^2}\frac{dx_t}{dz_t}+2\frac{\partial^2 a_{22}}{\partial z_t^2}\frac{dy_t}{dz_t}+\frac{\partial a_{12}}{\partial z_t}\frac{d^2x_t}{dz_t^2}+\frac{\partial^2 a_{12}}{\partial z_t\partial x_t}\left(\frac{dx_t}{dz_t}\right)^2+$$

$$\frac{\partial^2 a_{12}}{\partial z_t\partial y_t}\frac{dx_t}{dz_t}\frac{dy_t}{dz_t}+\frac{\partial a_{22}}{\partial z_t}\frac{d^2y_t}{dz_t^2}+\frac{\partial^2 a_{22}}{\partial z_t\partial x_t}\frac{dx_t}{dz_t}\frac{dy_t}{dz_t}+$$

$$\frac{\partial^2 a_{22}}{\partial z_t\partial y_t}\left(\frac{dy_t}{dz_t}\right)^2+2\frac{da_{12}}{dz_t}\frac{d^2x_t}{dz_t^2}+\frac{d^2a_{12}}{dz_t^2}\frac{dx_t}{dz_t}+2\frac{da_{22}}{dz_t}\frac{d^2y_t}{dz_t^2}+\frac{d^2a_{22}}{dz_t^2}\frac{dy_t}{dz_t}$$

-continued $$2\frac{\partial^2 a_{12}}{\partial x_t \partial y_t}\frac{dx_t}{dz_t}\frac{dy_t}{dz_t}+\frac{\partial a_{12}}{\partial y_t}\frac{d^2 y_t}{dz_t^2}+\frac{\partial^2 a_{12}}{\partial y_t^2}\left(\frac{dy_t}{dz_t}\right)^2$$

The following partial derivatives are required to complete the computation of the cubic terms of the Taylor series expansion.

$$\frac{\partial^3 a_x}{\partial z_t^3}=\sum_{n=1}^{N}\frac{3}{R_e(n)^3}\frac{\partial S(n)}{\partial x_t}\frac{\partial S(n)}{\partial z_t}\left[\frac{r(n)}{\sigma_1^2(n)}+\frac{V_e(n)v(n)}{\sigma_2^2(n)}\right]\left(5\left(\frac{\partial S(n)}{\partial z_t}\right)^2-3\right)+\frac{3v(n)}{\sigma_2^2(n)R_e(n)^2}\left\{\left[v_x(n)\frac{\partial S(n)}{\partial z_t}+3v_z(n)\frac{\partial S(n)}{\partial x_t}\right]\left(\left(\frac{\partial S(n)}{\partial z_t}\right)^2-1\right)+2v_z(n)\frac{\partial S(n)}{\partial x_t}\right\}$$

$$\frac{\partial^3 a_y}{\partial z_t^3}=\sum_{n=1}^{N}\frac{3}{R_e(n)^3}\frac{\partial S(n)}{\partial y_t}\frac{\partial S(n)}{\partial z_t}\left[\frac{r(n)}{\sigma_1^2(n)}+\frac{V_e(n)v(n)}{\sigma_2^2(n)}\right]\left(5\left(\frac{\partial S(n)}{\partial z_t}\right)^2-3\right)+\frac{3v(n)}{\sigma_2^2(n)R_e(n)^2}\left\{\left[v_y(n)\frac{\partial S(n)}{\partial z_t}+3v_z(n)\frac{\partial S(n)}{\partial y_t}\right]\left(\left(\frac{\partial S(n)}{\partial z_t}\right)^2-1\right)+2v_z(n)\frac{\partial S(n)}{\partial y_t}\right\}$$

$$\frac{\partial^2 a_{11}}{\partial x_t^2}=\sum_{n=1}^{N}\frac{12}{R_e(n)^2}\frac{\partial S(n)}{\partial x_t}\left(\frac{1}{R_e(n)}\frac{\partial S(n)}{\partial x_t}\left[\frac{r(n)}{\sigma_1^2(n)}+\frac{V_e(n)v(n)}{\sigma_2^2(n)}\right]+\frac{v(n)v_x(n)}{\sigma_2^2(n)}\right)\left(\left(\frac{\partial S(n)}{\partial x_t}\right)^2-1\right)+\frac{3}{R_e(n)^3}\left[\frac{r(n)}{\sigma_1^2(n)}+\frac{V_e(n)v(n)}{\sigma_2^2(n)}\right]\left(\left(\frac{\partial S(n)}{\partial x_t}\right)^2-1\right)^2$$

$$\frac{\partial^2 a_{22}}{\partial x_t^2}=\sum_{n=1}^{N}\frac{1}{R_e(n)^3}\left[\frac{r(n)}{\sigma_1^2(n)}+\frac{V_e(n)v(n)}{\sigma_2^2(n)}\right]\left[\left(3\left(\frac{\partial S(n)}{\partial x_t}\right)^2-1\right)\left(3\left(\frac{\partial S(n)}{\partial y_t}\right)^2-1\right)+6\left(\frac{\partial S(n)}{\partial x_t}\frac{\partial S(n)}{\partial y_t}\right)^2\right]+\frac{2v(n)}{\sigma_2^2(n)R_e(n)^2}\left[v_x(n)\frac{\partial S(n)}{\partial x_t}\left(3\left(\frac{\partial S(n)}{\partial y_t}\right)^2-1\right)+v_y(n)\frac{\partial S(n)}{\partial y_t}\left(3\left(\frac{\partial S(n)}{\partial x_t}\right)^2-1\right)\right]$$

$$\frac{\partial^2 a_{12}}{\partial x_t^2}=\sum_{n=1}^{N}\frac{3}{R_e(n)^3}\frac{\partial S(n)}{\partial x_t}\frac{\partial S(n)}{\partial y_t}\left[\frac{r(n)}{\sigma_1^2(n)}+\frac{V_e(n)v(n)}{\sigma_2^2(n)}\right]\left(5\left(\frac{\partial S(n)}{\partial x_t}\right)^2-3\right)+\frac{3v(n)}{\sigma_2^2(n)R_e(n)^2}\left\{\left[v_y(n)\frac{\partial S(n)}{\partial x_t}+3v_x(n)\frac{\partial S(n)}{\partial y_t}\right]\left(\left(\frac{\partial S(n)}{\partial x_t}\right)^2-1\right)+2v_x(n)\frac{\partial S(n)}{\partial y_t}\right\}$$

$$\frac{\partial^2 a_{11}}{\partial x_t \partial y_t}=\sum_{n=1}^{N}\frac{3}{R_e(n)^3}\frac{\partial S(n)}{\partial x_t}\frac{\partial S(n)}{\partial y_t}\left[\frac{r(n)}{\sigma_1^2(n)}+\right.$$

-continued $$\frac{V_e(n)v(n)}{\sigma_2^2(n)}\Bigg]\left(5\left(\frac{\partial S(n)}{\partial x_t}\right)^2-3\right)+\frac{3v(n)}{\sigma_2^2(n)R_e(n)^2}\Bigg\{\Bigg[v_y(n)\frac{\partial S(n)}{\partial x_t}+$$

$$3v_x(n)\frac{\partial S(n)}{\partial y_t}\Bigg]\left(\left(\frac{\partial S(n)}{\partial x_t}\right)^2-1\right)+2v_x(n)\frac{\partial S(n)}{\partial y_t}\Bigg\}$$

$$\frac{\partial^2 a_{22}}{\partial x_t\partial y_t}=\sum_{n=1}^{N}\frac{3}{R_e(n)^3}\frac{\partial S(n)}{\partial x_t}\frac{\partial S(n)}{\partial y_t}\Bigg[\frac{r(n)}{\sigma_1^2(n)}+$$

$$\frac{V_e(n)v(n)}{\sigma_2^2(n)}\Bigg]\left(5\left(\frac{\partial S(n)}{\partial y_t}\right)^2-3\right)+\frac{3v(n)}{\sigma_2^2(n)R_e(n)^2}\Bigg\{\Bigg[v_x(n)\frac{\partial S(n)}{\partial y_t}+$$

$$3v_y(n)\frac{\partial S(n)}{\partial x_t}\Bigg]\left(\left(\frac{\partial S(n)}{\partial y_t}\right)^2-1\right)+2v_y(n)\frac{\partial S(n)}{\partial x_t}\Bigg\}$$

$$\frac{\partial^2 a_{12}}{\partial x_t\partial y_t}=\sum_{n=1}^{N}\frac{1}{R_e(n)^3}\left[\frac{r(n)}{\sigma_1^2(n)}+\frac{V_e(n)v(n)}{\sigma_2^2(n)}\right]\Bigg[\left(3\left(\frac{\partial S(n)}{\partial x_t}\right)^2-1\right)\left(3\left(\frac{\partial S(n)}{\partial y_t}\right)^2-1\right)+$$

$$6\left(\frac{\partial S(n)}{\partial x_t}\frac{\partial S(n)}{\partial y_t}\right)^2\Bigg]+\frac{2v(n)}{\sigma_2^2(n)R_e(n)^2}\Bigg[v_x(n)\frac{\partial S(n)}{\partial x_t}\left(3\left(\frac{\partial S(n)}{\partial y_t}\right)^2-1\right)+$$

$$v_y(n)\frac{\partial S(n)}{\partial y_t}\left(3\left(\frac{\partial S(n)}{\partial x_t}\right)^2-1\right)\Bigg]$$

$$\frac{\partial^2 a_{11}}{\partial x_t\partial z_t}=\sum_{n=1}^{N}\frac{3}{R_e(n)^3}\frac{\partial S(n)}{\partial x_t}\frac{\partial S(n)}{\partial z_t}\Bigg[\frac{r(n)}{\sigma_1^2(n)}+$$

$$\frac{V_e(n)v(n)}{\sigma_2^2(n)}\Bigg]\left(5\left(\frac{\partial S(n)}{\partial x_t}\right)^2-3\right)+\frac{3v(n)}{\sigma_2^2(n)R_e(n)^2}\Bigg\{\Bigg[v_z(n)\frac{\partial S(n)}{\partial x_t}+$$

$$3v_x(n)\frac{\partial S(n)}{\partial z_t}\Bigg]\left(\left(\frac{\partial S(n)}{\partial x_t}\right)^2-1\right)+2v_x(n)\frac{\partial S(n)}{\partial z_t}\Bigg\}$$

$$\frac{\partial^2 a_{22}}{\partial x_t\partial z_t}=\sum_{n=1}^{N}\frac{3}{R_e(n)^3}\frac{\partial S(n)}{\partial x_t}\frac{\partial S(n)}{\partial z_t}\Bigg[\frac{r(n)}{\sigma_1^2(n)}+$$

$$\frac{V_e(n)v(n)}{\sigma_2^2(n)}\Bigg]\left(5\left(\frac{\partial S(n)}{\partial y_t}\right)^2-1\right)+\frac{v(n)}{\sigma_2^2(n)R_e(n)^2}\Bigg\{\Bigg[v_z(n)\frac{\partial S(n)}{\partial x_t}+$$

$$v_x(n)\frac{\partial S(n)}{\partial z_t}\Bigg]\left(3\left(\frac{\partial S(n)}{\partial y_t}\right)^2-1\right)+6v_y(n)\frac{\partial S(n)}{\partial x_t}\frac{\partial S(n)}{\partial y_t}\frac{\partial S(n)}{\partial z_t}\Bigg\}$$

$$\frac{\partial^2 a_{12}}{\partial x_t\partial z_t}=\sum_{n=1}^{N}\frac{3}{R_e(n)^3}\frac{\partial S(n)}{\partial y_t}\frac{\partial S(n)}{\partial z_t}\Bigg[\frac{r(n)}{\sigma_1^2(n)}+$$

$$\frac{V_e(n)v(n)}{\sigma_2^2(n)}\Bigg]\left(5\left(\frac{\partial S(n)}{\partial x_t}\right)^2-1\right)+\frac{v(n)}{\sigma_2^2(n)R_e(n)^2}\Bigg\{\Bigg[v_z(n)\frac{\partial S(n)}{\partial y_t}+$$

$$v_y(n)\frac{\partial S(n)}{\partial z_t}\Bigg]\left(3\left(\frac{\partial S(n)}{\partial x_t}\right)^2-1\right)+6v_x(n)\frac{\partial S(n)}{\partial x_t}\frac{\partial S(n)}{\partial y_t}\frac{\partial S(n)}{\partial z_t}\Bigg\}$$

$$\frac{\partial^2 a_{11}}{\partial y_t^2}=\sum_{n=1}^{N}\frac{1}{R_e(n)^3}\left[\frac{r(n)}{\sigma_1^2(n)}+\right.$$

-continued $$\frac{V_e(n)v(n)}{\sigma_2^2(n)}\Bigg]\Bigg[\left(3\left(\frac{\partial S(n)}{\partial x_t}\right)^2-1\right)\left(3\left(\frac{\partial S(n)}{\partial y_t}\right)^2-1\right)+$$

$$6\left(\frac{\partial S(n)}{\partial x_t}\ \frac{\partial S(n)}{\partial y_t}\right)^2\Bigg]+\frac{2v(n)}{\sigma_2^2(n)R_e(n)^2}\left[v_x(n)\frac{\partial S(n)}{\partial x_t}\left(3\left(\frac{\partial S(n)}{\partial y_t}\right)^2-1\right)+\right.$$

$$\left.v_y(n)\frac{\partial S(n)}{\partial y_t}\left(3\left(\frac{\partial S(n)}{\partial x_t}\right)^2-1\right)\right]$$

$$\frac{\partial^2 a_{22}}{\partial y_t^2}=\sum_{n=1}^{N}\frac{12}{R_e(n)^2}\ \frac{\partial S(n)}{\partial y_t}\left(\frac{1}{R_e(n)}\ \frac{\partial S(n)}{\partial y_t}\left[\frac{r(n)}{\sigma_1^2(n)}+\right.\right.$$

$$\left.\frac{V_e(n)v(n)}{\sigma_2^2(n)}\right]+\frac{v(n)v_y(n)}{\sigma_2^2(n)}\Bigg)\left(\left(\frac{\partial S(n)}{\partial y_t}\right)^2-1\right)+$$

$$\frac{3}{R_e(n)^3}\left[\frac{r(n)}{\sigma_1^2(n)}+\frac{V_e(n)v(n)}{\sigma_2^2(n)}\right]\left(\left(\frac{\partial S(n)}{\partial y_t}\right)^2-1\right)^2$$

$$\frac{\partial^2 a_{12}}{\partial y_t^2}=\sum_{n=1}^{N}\frac{3}{R_e(n)^3}\ \frac{\partial S(n)}{\partial x_t}\ \frac{\partial S(n)}{\partial y_t}\left[\frac{r(n)}{\sigma_1^2(n)}+\right.$$

$$\left.\frac{V_e(n)v(n)}{\sigma_2^2(n)}\right]\left(5\left(\frac{\partial S(n)}{\partial y_t}\right)^2-3\right)+\frac{3v(n)}{\sigma_2^2(n)R_e(n)^2}\left\{\left[v_x(n)\frac{\partial S(n)}{\partial y_t}+\right.\right.$$

$$\left.\left.3v_y(n)\frac{\partial S(n)}{\partial x_t}\right]\left(\left(\frac{\partial S(n)}{\partial y_t}\right)^2-1\right)+2v_y(n)\frac{\partial S(n)}{\partial x_t}\right\}$$

$$\frac{\partial^2 a_{11}}{\partial y_t\partial z_t}=\sum_{n=1}^{N}\frac{3}{R_e(n)^3}\ \frac{\partial S(n)}{\partial y_t}\ \frac{\partial S(n)}{\partial z_t}\left[\frac{r(n)}{\sigma_1^2(n)}+\right.$$

$$\left.\frac{V_e(n)v(n)}{\sigma_2^2(n)}\right]\left(5\left(\frac{\partial S(n)}{\partial x_t}\right)^2-1\right)+\frac{v(n)}{\sigma_2^2(n)R_e(n)^2}\left\{\left[v_z(n)\frac{\partial S(n)}{\partial y_t}+\right.\right.$$

$$\left.\left.v_y(n)\frac{\partial S(n)}{\partial z_t}\right]\left(3\left(\frac{\partial S(n)}{\partial x_t}\right)^2-1\right)+6v_x(n)\frac{\partial S(n)}{\partial x_t}\ \frac{\partial S(n)}{\partial y_t}\ \frac{\partial S(n)}{\partial z_t}\right\}$$

$$\frac{\partial^2 a_{22}}{\partial y_t\partial z_t}=\sum_{n=1}^{N}\frac{3}{R_e(n)^3}\ \frac{\partial S(n)}{\partial y_t}\ \frac{\partial S(n)}{\partial z_t}\left[\frac{r(n)}{\sigma_1^2(n)}+\right.$$

$$\left.\frac{V_e(n)v(n)}{\partial_2^2(n)}\right]\left(5\left(\frac{\partial S(n)}{\partial y_t}\right)^2-3\right)+\frac{3v(n)}{\sigma_2^2(n)R_e(n)^2}\left\{\left[v_z(n)\frac{\partial S(n)}{\partial y_t}+\right.\right.$$

$$\left.\left.3v_y(n)\frac{\partial S(n)}{\partial z_t}\right]\left(\left(\frac{\partial S(n)}{\partial y_t}\right)^2-1\right)+2v_y(n)\frac{\partial S(n)}{\partial z_t}\right\}$$

$$\frac{\partial^2 a_{12}}{\partial y_t\partial z_t}=\sum_{n=1}^{N}\frac{3}{R_e(n)^3}\ \frac{\partial S(n)}{\partial x_t}\ \frac{\partial S(n)}{\partial z_t}\left[\frac{r(n)}{\sigma_1^2(n)}+\right.$$

$$\left.\frac{V_e(n)v(n)}{\sigma_2^2(n)}\right]\left(5\left(\frac{\partial S(n)}{\partial y_t}\right)^2-1\right)+\frac{v(n)}{\sigma_2^2(n)R_e(n)^2}\left\{\left[v_z(n)\frac{\partial S(n)}{\partial x_t}+\right.\right.$$

$$\left.\left.v_x(n)\frac{\partial S(n)}{\partial z_t}\right]\left(3\left(\frac{\partial S(n)}{\partial y_t}\right)^2-1\right)+6v_y(n)\frac{\partial S(n)}{\partial x_t}\ \frac{\partial S(n)}{\partial y_t}\ \frac{\partial S(n)}{\partial z_t}\right\}$$

-continued $$\frac{\partial^2 a_{11}}{\partial z_t^2} = \sum_{n=1}^{N} \frac{1}{R_e(n)^3}\left[\frac{r(n)}{\sigma_1^2(n)} + \frac{V_e(n)v(n)}{\sigma_2^2(n)}\right]\left[\left(3\left(\frac{\partial S(n)}{\partial x_t}\right)^2 - 1\right)\left(3\left(\frac{\partial S(n)}{\partial z_t}\right)^2 - 1\right) + \left(6\left(\frac{\partial S(n)}{\partial x_t}\ \frac{\partial S(n)}{\partial z_t}\right)^2\right)\right] + \frac{2v(n)}{\sigma_2^2(n)R_e(n)^2}\left[v_x(n)\frac{\partial S(n)}{\partial x_t}\left(3\left(\frac{\partial S(n)}{\partial z_t}\right)^2 - 1\right) + v_z(n)\frac{\partial S(n)}{\partial z_t}\left(3\left(\frac{\partial S(n)}{\partial x_t}\right)^2 - 1\right)\right]$$

$$\frac{\partial^2 a_{22}}{\partial z_t^2} = \sum_{n=1}^{N} \frac{1}{R_e(n)^3}\left[\frac{r(n)}{\sigma_1^2(n)} + \frac{V_e(n)v(n)}{\sigma_2^2(n)}\right]\left[\left(3\left(\frac{\partial S(n)}{\partial y_t}\right)^2 - 1\right)\left(3\left(\frac{\partial S(n)}{\partial z_t}\right)^2 - 1\right) + 6\left(\frac{\partial S(n)}{\partial y_t}\ \frac{\partial S(n)}{\partial z_t}\right)^2\right] + \frac{2v(n)}{\sigma_2^2(n)R_e(n)^2}\left[v_y(n)\frac{\partial S(n)}{\partial y_t}\left(3\left(\frac{\partial S(n)}{\partial z_t}\right)^2 - 1\right) + v_z(n)\frac{\partial S(n)}{\partial z_t}\left(3\left(\frac{\partial S(n)}{\partial y_t}\right)^2 - 1\right)\right]$$

$$\frac{\partial^2 a_{12}}{\partial z_t^2} = \sum_{n=1}^{N} \frac{3}{R_e(n)^3}\ \frac{\partial S(n)}{\partial x_t}\ \frac{\partial S(n)}{\partial y_t}\left[\frac{r(n)}{\sigma_1^2(n)} + \frac{V_e(n)v(n)}{\sigma_2^2(n)}\right]\left(5\left(\frac{\partial S(n)}{\partial z_t}\right)^2 - 1\right) + \frac{v(n)}{\sigma_2^2(n)R_e(n)^2}\left\{\left[v_y(n)\frac{\partial S(n)}{\partial x_t} + v_x(n)\frac{\partial S(n)}{\partial y_t}\right]\left(3\left(\frac{\partial S(n)}{\partial z_t}\right)^2 - 1\right) + 6v_z(n)\frac{\partial S(n)}{\partial x_t}\ \frac{\partial S(n)}{\partial y_t}\ \frac{\partial S(n)}{\partial z_t}\right\}$$

The expressions for the derivatives of S(n) are substituted in to arrive at the final form.

$$\frac{\partial^3 a_x}{\partial z_t^3} = \sum_{n=1}^{N} \frac{3[x(n) - x_t][z(n) - z_t]}{R_e(n)^5}\left[\frac{r(n)}{\sigma_1^2(n)} + \frac{V_e(n)v(n)}{\sigma_2^2(n)}\right]\left(5\frac{[z(n) - z_t]^2}{R_e(n)^2} - 3\right) - \frac{3v(n)[x(n) - x_t][z(n) - z_t]}{\sigma_2^2(n)R_e(n)^3}\left\{\left[\frac{v_x(n)}{x(n) - x_t} + 3\frac{v_z(n)}{z(n) - z_t}\right]\left(\frac{[z(n) - z_t]^2}{R_e(n)^2} - 1\right) + 2\frac{v_z(n)}{z(n) - z_t}\right\}$$

$$\frac{\partial^3 a_y}{\partial z_t^3} = \sum_{n=1}^{N} \frac{3[y(n) - y_t][z(n) - z_t]}{R_e(n)^5}\left[\frac{r(n)}{\sigma_1^2(n)} + \frac{V_e(n)v(n)}{\sigma_2^2(n)}\right]\left(5\frac{[z(n) - z_t]^2}{R_e(n)^2} - 3\right) - \frac{3v(n)[y(n) - y_t][z(n) - z_t]}{\sigma_2^2(n)R_e(n)^3}\left\{\left[\frac{v_y(n)}{y(n) - y_t} + 3\frac{v_z(n)}{z(n) - z_t}\right]\left(\frac{[z(n) - z_t]^2}{R_e(n)^2} - 1\right) + 2\frac{v_z(n)}{z(n) - z_t}\right\}$$

-continued $$\frac{\partial^2 a_{11}}{\partial x_t^2} = \sum_{n=1}^{N} \frac{12[x(n) - x_t]}{R_e(n)^3} \left( \frac{x(n) - x_t}{R_e(n)^2} \left[ \frac{r(n)}{\sigma_1^2(1n)} + \frac{V_e(n)v(n)}{\sigma_2^2(n)} \right] - \frac{v(n)v_x(n)}{\sigma_2^2(n)} \right) \left( \frac{[x(n) - x_t]^2}{R_e(n)^2} - 1 \right) + \frac{3}{R_e(n)^3} \left[ \frac{r(n)}{\sigma_1^2(n)} + \frac{V_e(n)v(n)}{\sigma_2^2(n)} \right] \left( \frac{[x(n) - x_t]^2}{R_e(n)^2} - 1 \right)^2$$

$$\frac{\partial^2 a_{22}}{\partial x_t^2} = \sum_{n=1}^{N} \frac{-2v(n)}{\sigma_2^2(n) R_e(n)^3} \left[ v_x(n)[x(n) - x_t] \left( 3 \frac{[y(n) - y_t]^2}{R_e(n)^2} - 1 \right) + v_y(n)[y(n) - y_t] \left( 3 \frac{[x(n) - x_t]^2}{R_e(n)^2} - 1 \right) \right] + \frac{1}{R_e(n)^3} \left[ \frac{r(n)}{\sigma_1^2(n)} + \frac{V_e(n)v(n)}{\sigma_2^2(n)} \right] \left[ \left( 3 \frac{[x(n) - x_t]^2}{R_e(n)^2} - 1 \right) \left( 3 \frac{[y(n) - y_t]^2}{R_e(n)^2} - 1 \right) + 6 \frac{[x(n) - x_t]^2 [y(n) - y_t]^2}{R_e(n)^4} \right]$$

$$\frac{\partial^2 a_{12}}{\partial x_t^2} = \sum_{n=1}^{N} \frac{3[x(n) - x_t][y(n) - y_t]}{R_e(n)^5} \left[ \frac{r(n)}{\sigma_1^2(n)} + \frac{V_e(n)v(n)}{\sigma_2^2(n)} \right] \left( 5 \frac{[x(n) - x_t]^2}{R_e(n)^2} - 3 \right) - \frac{3v(n)[x(n) - x_t][y(n) - y_t]}{\sigma_2^2(n) R_e(n)^3} \left\{ \left[ \frac{v_y(n)}{y(n) - y_t} + 3 \frac{v_x(n)}{x(n) - x_t} \right] \left( \frac{[x(n) - x_t]^2}{r_e(n)^2} - 1 \right) + 2 \frac{v_x(n)}{x(n) - x_t} \right\}$$

$$\frac{\partial^2 a_{11}}{\partial x_t \partial y_t} = \sum_{n=1}^{N} \frac{3[x(n) - x_t][y(n) - y_t]}{R_e(n)^5} \left[ \frac{r(n)}{\sigma_1^2(n)} + \frac{V_e(n)v(n)}{\sigma_2^2(n)} \right] \left( 5 \frac{[x(n) - x_t]^2}{R_e(n)^2} - 3 \right) - \frac{3v(n)[x(n) - x_t][y(n) - y_t]}{\sigma_2^2(n) R_e(n)^3} \left\{ \left[ \frac{v_y(n)}{y(n) - y_t} + 3 \frac{v_x(n)}{x(n) - x_t} \right] \left( \frac{[x(n) - x_t]^2}{R_e(n)^2} - 1 \right) + 2 \frac{v_x(n)}{x(n) - x_t} \right\}$$

$$\frac{\partial^2 a_{22}}{\partial x_t \partial y_t} = \sum_{n=1}^{N} \frac{3[x(n) - x_t][y(n) - y_t]}{R_e(n)^5} \left[ \frac{r(n)}{\sigma_1^2(n)} + \frac{V_e(n)v(n)}{\sigma_2^2(n)} \right] \left( 5 \frac{[y(n) - y_t]^2}{R_e(n)^2} - 3 \right) - \frac{3v(n)[x(n) - x_t][y(n) - y_t]}{\sigma_2^2(n) R_e(n)^3} \left\{ \left[ \frac{v_x(n)}{x(n) - x_t} + 3 \frac{v_y(n)}{y(n) - y_t} \right] \left( \frac{[y(n) - y_t]^2}{R_e(n)^2} - 1 \right) + 2 \frac{v_y(n)}{y(n) - y_t} \right\}$$

$$\frac{\partial^2 a_{12}}{\partial x_t \partial y_t} = \sum_{n=1}^{N} \frac{-2v(n)}{\sigma_2^2(n) R_e(n)^3} \left[ v_x(n)[x(n) - x_t] \left( 3 \frac{[y(n) - y_t]^2}{R_e(n)^2} - 1 \right) + v_y(n)[y(n) - y_t] \left( 3 \frac{[x(n) - x_t]^2}{R_e(n)^2} - 1 \right) \right] + \frac{1}{R_e(n)^3} \left[ \frac{r(n)}{\sigma_1^2(n)} + \right.$$

-continued $$\frac{V_e(n)v(n)}{\sigma_2^2(n)}\Bigg]\Bigg[\left(3\frac{[x(n)-x_t]^2}{R_e(n)^2}-1\right)\left(3\frac{[y(n)-y_t]^2}{R_e(n)^2}-1\right)+6\frac{[x(n)-x_t]^2[y(n)-y_t]^2}{R_e(n)^4}\Bigg]$$

$$\frac{\partial^2 a_{11}}{\partial x_t \partial y_t}=\sum_{n=1}^{N}\frac{3[x(n)-x_t][z(n)-z_t]}{R_e(n)^5}\Bigg[\frac{r(n)}{\sigma_1^2(n)}+$$

$$\frac{V_e(n)v(n)}{\sigma_2^2(n)}\Bigg]\left(5\frac{[x(n)-x_t]^2}{R_e(n)^2}-3\right)-\frac{3v(n)[x(n)-x_t][z(n)-z_t]}{\sigma_2^2(n)R_e(n)^3}\Bigg\{\Bigg[\frac{v_z(n)}{z(n)-z_t}+$$

$$3\frac{v_x(n)}{x(n)-x_t}\Bigg]\left(\frac{[x(n)-x_t]^2}{R_e(n)^2}-1\right)+2\frac{v_x(n)}{x(n)-x_t}\Bigg\}$$

$$\frac{\partial^2 a_{22}}{\partial x_t \partial z_t}=\sum_{n=1}^{N}\frac{3[x(n)-x_t][z(n)-z_t]}{R_e(n)^5}\Bigg[\frac{r(n)}{\sigma_1^2(n)}+\frac{V_e(n)v(n)}{\sigma_2^2(n)}\Bigg]\left(5\frac{[y(n)-y_t]^2}{R_e(n)^2}-1\right)-$$

$$\frac{v(n)[x(n)-x_t][z(n)-z_t]}{\sigma_2^2(n)R_e(n)^3}\Bigg\{\Bigg[\frac{v_z(n)}{z(n)-z_t}+\frac{v_x(n)}{x(n)-x_t}\Bigg]\left(3\frac{[y(n)-y_t]^2}{R_e(n)^2}-1\right)+$$

$$6v_y(n)\frac{y(n)-y_1}{R_e(n)^2}\Bigg\}$$

$$\frac{\partial^2 a_{12}}{\partial x_t \partial z_t}=\sum_{n=1}^{N}\frac{3[y(n)-y_t][z(n)-z_t]}{R_e(n)^5}\Bigg[\frac{r(n)}{\sigma_1^2(n)}+\frac{V_e(n)v(n)}{\sigma_2^2(n)}\Bigg]\left(5\frac{[x(n)-x_t]^2}{R_e(n)^2}-1\right)-$$

$$\frac{v(n)[y(n)-y_t][z(n)-z_t]}{\sigma_2^2(n)R_e(n)^3}\Bigg\{\Bigg[\frac{v_z(n)}{z(n)-z_t}+\frac{v_y(n)}{y(n)-y_t}\Bigg]\left(3\frac{[x(n)-x_t]^2}{R_e(n)^2}-1\right)+$$

$$6v_x(n)\frac{x(n)-x_1}{R_e(n)^2}\Bigg\}$$

$$\frac{\partial^2 a_{11}}{\partial y_t^2}=\sum_{n=1}^{N}\frac{-2v(n)}{\sigma_2^2(n)R_e(n)^3}\Bigg[v_x(n)[x(n)-x_t]\left(3\frac{[y(n)-y_t]^2}{R_e(n)^2}-1\right)+$$

$$v_y(n)[y(n)-y_t]\left(3\frac{[x(n)-x_t]^2}{R_e(n)^2}-1\right)\Bigg]+\frac{1}{R_e(n)^3}\Bigg[\frac{r(n)}{\sigma_1^2(n)}+$$

$$\frac{V_e(n)v(n)}{\sigma_2^2(n)}\Bigg]\Bigg[\left(3\frac{[x(n)-x_t]^2}{R_e(n)^2}-1\right)\left(3\frac{[y(n)-y_t]^2}{R_e(n)^2}-1\right)+$$

$$6\frac{[x(n)-x_t]^2[y(n)-y_t]^2}{R_e(n)^4}\Bigg]$$

$$\frac{\partial^2 a_{22}}{\partial y_t^2}=\sum_{n=1}^{N}\frac{12[y(n)-y_t]}{R_e(n)^3}\Bigg(\frac{y(n)-y_t}{R_e(n)^2}\Bigg[\frac{r(n)}{\sigma_1^2(n)}+$$

$$\frac{V_e(n)v(n)}{\sigma_2^2(n)}\Bigg]-\frac{v(n)v_y(n)}{\sigma_2^2(n)}\Bigg)\left(\frac{[y(n)-y_t]^2}{R_e(n)^2}-1\right)+$$

$$\frac{3}{R_e(n)^3}\Bigg[\frac{r(n)}{\sigma_1^2(n)}+\frac{V_e(n)v(n)}{\sigma_2^2(n)}\Bigg]\left(\frac{[y(n)-y_t]^2}{R_e(n)^2}-1\right)^2$$

-continued $$\frac{\partial^2 a_{12}}{\partial y_t^2} = \sum_{n=1}^{N} \frac{3[x(n)-x_t][y(n)-y_t]}{R_e(n)^5}\left[\frac{r(n)}{\sigma_1^2(n)} + \frac{V_e(n)v(n)}{\sigma_2^2(n)}\right]\left(5\frac{[y(n)-y_t]^2}{R_e(n)^2} - 3\right) - \frac{3v(n)[x(n)-x_t][y(n)-y_t]}{\sigma_2^2(n)R_e(n)^3}\left\{\left[\frac{v_x(n)}{x(n)-x_t} + 3\frac{v_y(n)}{y(n)-y_t}\right]\left(\frac{[y(n)-y_t]^2}{R_e(n)^2} - 1\right) + 2\frac{v_y(n)}{y(n)-y_t}\right\}$$

$$\frac{\partial^2 a_{11}}{\partial y_t \partial z_t} = \sum_{n=1}^{N} \frac{3[y(n)-y_t][z(n)-z_t]}{R_e(n)^5}\left[\frac{r(n)}{\sigma_1^2(n)} + \frac{V_e(n)v(n)}{\sigma_2^2(n)}\right]\left(5\frac{[x(n)-x_t]^2}{R_e(n)^2} - 1\right) - \frac{v(n)[y(n)-y_t][z(n)-z_t]}{\sigma_2^2(n)R_e(n)^3}\left\{\left[\frac{v_z(n)}{z(n)-z_t} + \frac{v_y(n)}{y(n)-y_t}\right]\left(3\frac{[x(n)-x_t]^2}{R_e(n)^2} - 1\right) + 6v_x(n)\frac{x(n)-x_t}{R_e(n)^2}\right\}$$

$$\frac{\partial^2 a_{22}}{\partial y_t \partial z_t} = \sum_{n=1}^{N} \frac{3[y(n)-y_t][z(n)-z_t]}{R_e(n)^5}\left[\frac{r(n)}{\sigma_1^2(n)} + \frac{V_e(n)v(n)}{\sigma_2^2(n)}\right]\left(5\frac{[y(n)-y_t]^2}{R_e(n)^2} - 3\right) - \frac{3v(n)[y(n)-y_t][z(n)-z_t]}{\sigma_2^2(n)R_e(n)^3}\left\{\left[\frac{v_z(n)}{z(n)-z_t} + 3\frac{v_y(n)}{y(n)-y_t}\right]\left(\frac{[y(n)-y_t]^2}{R_e(n)^2} - 1\right) + 2\frac{v_y(n)}{y(n)-y_t}\right\}$$

$$\frac{\partial^2 a_{12}}{\partial y_t \partial z_t} = \sum_{n=1}^{N} \frac{3[x(n)-x_t][z(n)-z_t]}{R_e(n)^5}\left[\frac{r(n)}{\sigma_1^2(n)} + \frac{V_e(n)v(n)}{\sigma_2^2(n)}\right]\left(5\frac{[y(n)-y_t]^2}{R_e(n)^2} - 1\right) - \frac{v(n)[x(n)-x_t][z(n)-z_t]}{\sigma_2^2(n)R_e(n)^3}\left\{\left[\frac{v_z(n)}{z(n)-z_t} + \frac{v_x(n)}{x(n)-x_t}\right]\left(3\frac{[y(n)-y_t]^2}{R_e(n)^2} - 1\right) + 6v_y(n)\frac{y(n)-y_t}{R_e(n)^2}\right\}$$

$$\frac{\partial^2 a_{11}}{\partial z_t^2} = \sum_{n=1}^{N} \frac{-2v(n)}{\sigma_2^2(n)R_e(n)^3}\left[v_x(n)[x(n)-x_t]\left(3\frac{[z(n)-z_t]^2}{R_e(n)^2} - 1\right) + v_z(n)[z(n)-z_t]\left(3\frac{[x(n)-x_t]^2}{R_e(n)^2} - 1\right)\right] + \frac{1}{R_e(n)^3}\left[\frac{r(n)}{\sigma_1^2(n)} + \frac{V_e(n)v(n)}{\sigma_2^2(n)}\right]\left[\left(3\frac{[x(n)-x_t]^2}{R_e(n)^2} - 1\right)\left(3\frac{[z(n)-z_t]^2}{R_e(n)^2} - 1\right) + 6\frac{[x(n)-x_t]^2\,[z(n)-z_t]^2}{R_e(n)^4}\right]$$

$$\frac{\partial^2 a_{22}}{\partial z_t^2} = \sum_{n=1}^{N} \frac{-2v(n)}{\sigma_2^2(n)R_e(n)^3}\left[v_y(n)[y(n)-y_t]\left(3\frac{[z(n)-z_t]^2}{R_e(n)^2} - 1\right) +\right.$$

-continued $$v_z(n)[z(n)-z_t]\left(3\frac{[y(n)-y_t]^2}{R_e(n)^2}-1\right)\Bigg]+\frac{1}{R_e(n)^3}\left[\frac{r(n)}{\sigma_1^2(n)}+\frac{V_e(n)v(n)}{\sigma_2^2(n)}\right]\left[\left(3\frac{[y(n)-y_t]^2}{R_e(n)^2}-1\right)\left(3\frac{[z(n)-z_t]^2}{R_e(n)^2}-1\right)+6\frac{[y(n)-y_t]^2\,[z(n)-z_t]^2}{R_e(n)^4}\right]$$

$$\frac{\partial^2 a_{12}}{\partial z_t^2}=\sum_{n=1}^{N}\frac{3[x(n)-x_t][y(n)-y_t]}{R_e(n)^5}\left[\frac{r(n)}{\sigma_1^2(n)}+\frac{V_e(n)v(n)}{\sigma_2^2(n)}\right]\left(5\frac{[z(n)-z_t]^2}{R_e(n)^2}-1\right)-\frac{v(n)[x(n)-x_t][y(n)-y_t]}{\sigma_2^2(n)R_e(n)^3}\left\{\left[\frac{v_y(n)}{y(n)-y_t}+\frac{v_x(n)}{x(n)-x_t}\right]\left(3\frac{[z(n)-z_t]^2}{R_e(n)^2}-1\right)+6v_z(n)\frac{z(n)-z_t}{R_e(n)^2}\right\}$$

Determining the equations for the optimum flight path: The flight path that is used is described by the following two equations.

$$x = x_t + \frac{dx_t}{dz_t}\Big|(z-z_t)+\frac{1}{2}\frac{d^2x_t}{dz_t^2}\Big|(z-z_t)^2+\frac{1}{6}\frac{d^3x_t}{dz_t^3}\Big|(z-z_t)^3$$

$$y = y_t + \frac{dy_t}{dz_t}\Big|(z-z_t)+\frac{1}{2}\frac{d^2y_t}{dz_t^2}\Big|(z-z_t)^2+\frac{1}{6}\frac{d^3y_t}{dz_t^3}\Big|(z-z_t)^3$$

where $z_t$ is the ground plane used for computing $(x_t,y_t)$

The coefficients associated with the linear terms are computed using equations 3 and 4. The coefficients associated with the quadratic terms are computed using equations 7 and 8 and the coefficients associated with the cubic terms are computed using equations 12 and 13. The target miss distance is determined by finding the intersection of the line with the true target plane. The weapon impact point can be determined by substituting the true target altitude for z and solving for x and y. The miss distance is then equal to the separation between the weapon impact point and the true target x-y in the true target plane.

What is claimed is:

1. An autonomous weapon targeting and guidance system for identifying a non-moving fixed or relocatable target and guiding a weapon to the target, said system comprising:

an airborne platform comprising a synthetic array radar (SAR) system adapted to detect a non-moving, fixed or relocatable target, a navigation subsytem, and processing means for processing SAR data and navigation data to compute the position of the target and an optimum weapon flight path from the platform to the target using a predetermined computational procedure; and a weapon having a navigation subsystem which utilizes a transfer alignment algorithm to align the weapon's navigation system with the airborne platform's navigation system prior to launch, which weapon is adapted to respond to data transferred to it by the platform to permit it to navigate relative to the navigation system of the airborne platform and autonomously navigate to the location of the target along the optimum weapon flight path.

2. The system of claim 1 wherein the navigation subsystems of the airborne platform and weapon are each adapted to utilize a global positioning system (GPS) satellite system.

3. The system of claim 1 wherein the airborne platform is adapted to transfer target position, satellite, and flight path information to the weapon prior to its launch for use by the weapon during its flight along the optimum weapon flight path to the target.

4. The system of claim 2 wherein the airborne platform is adapted to transfer target position, satellite, and flight path information to the weapon prior to its launch for use by the weapon during its flight along the optimum weapon flight path to the target.

5. The system of claim 1 wherein the target is a fixed target.

6. The system of claim 1 wherein the target is a relocatable target.

7. An autonomous weapon targeting and guidance system for identifying a non-moving target and guiding a weapon to the target, said system comprising:

a global positioning system (GPS) comprising a plurality of satellites that broadcast position data to provide a coordinate reference frame;

an airborne platform comprising a synthetic array radar (SAR) system adapted to detect a non-moving target, a navigation subsystem that utilizes a global positioning system (GPS) satellite system and which is adapted to respond to signals provided by the GPS satellite system to permit the platform to navigate relative thereto, and processing means for processing SAR data and navigation data to compute the position of the target and an optimum weapon flight path from the platform to the target using a predetermined computational procedure; and a weapon comprising a navigation subsystem that is adapted to utilize the GPS satellite system and which responds to signals provided by the GPS satellite system and data transferred to it by the platform to permit it to navigate relative to the GPS satellite system and autonomously navigate to the location of the target along the optimum weapon flight path.

8. The system of claim 7 wherein the airborne platform is adapted to transfer target position, satellite, and flight path information to the weapon prior to its launch for use by the weapon during its flight along the optimum weapon flight path to the target.

9. A method for detecting a non-moving target and guiding an airborne weapon to the target, said method comprising the steps of:

providing a global positioning system comprised of a plurality of satellites that each broadcast coordinate reference data for use in navigation;

flying an airborne platform over a target area and navigating using a navigation system that utilizes the GPS satellite system which provides the coordinate reference frame;

mapping the target area using a synthetic array radar (SAR) system located on the airborne platform to produce an original SAR map of the target area;

designating a target on the SAR map;

re-mapping the target area a predetermined number of additional times at different angles relative to the target using the synthetic array radar system to produce a predetermine number of additional SAR maps of the target area;

computing a precise target location and flight path in the coordinate system provided by the global positioning system using the navigation data and the information from each of the SAR maps;

transferring selected information to the weapon prior to its launch comprising data indicative of an optimum flight path to the target that should be flown by the weapon, navigation system initialization information that permits the weapon to acquire the satellites used by the platform for navigation, and target position information; and launching the weapon using a navigation system in the weapon to acquire the satellites used by the platform for navigation and guide the weapon to the target based on the optimum flight path computed in the platform.

10. The method of claim 9 which further comprises the step of correlating the images from the additional SAR maps with the original SAR map prior to computing the precise target location and flight path to eliminate the need for repeated target designation.

11. The method of claim 9 which further comprises the step of providing target cueing information that is adapted to assist an operator in designating a target.

12. The method of claim 9 which further comprises the step of matching subsequent SAR maps to the initial SAR map by automatically determining a coordinate transformation that aligns all SAR images to ensure that the additional SAR maps are correlated to the initial SAR map, such that the target designated in each subsequent map is the same target designated in the first map.

13. A method for detecting a non-moving target and guiding an airborne weapon to the target, said method comprising the steps of:

providing a global positioning system comprised of a plurality of satellites that each broadcast coordinate reference data for use in navigation;

flying an airborne platform over a target area and navigating using a navigation system that utilizes the GPS satellite system which provides the coordinate reference frame;

mapping the target area using a synthetic array radar (SAR) system located on the airborne platform to produce an original SAR map of the target area;

designating a target on the SAR map;

re-mapping the target area a predetermined number of additional times at different angles relative to the target using the synthetic array radar system to produce a predetermine number of additional SAR maps of the target area;

correlating the images from the additional SAR maps with the original SAR map to eliminate the need for repeated target designation;

computing a precise target location and flight path in the coordinate system provided by the global positioning system using the navigation data and the information from each of the SAR maps;

transferring selected information to the weapon prior to its launch comprising data indicative of an optimum flight path to the target that should be flown by the weapon, navigation system initialization information that permits the weapon to acquire the satellites used by the platform for navigation, and target position information; and launching the weapon using a navigation system in the weapon to acquire the satellites used by the platform for navigation and guide the weapon to the target based on the optimum flight path computed in the platform.

* * * * *